US010442194B2

(12) United States Patent
Mori

(10) Patent No.: US 10,442,194 B2
(45) Date of Patent: Oct. 15, 2019

(54) HEAD MODULE, LIQUID JETTING APPARATUS INCLUDING THE SAME, AND CASE

(71) Applicant: BROTHER KOGYO KABUSHIKI KAISHA, Nagoya-shi, Aichi-ken (JP)

(72) Inventor: Shogo Mori, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 18 days.

(21) Appl. No.: 15/649,767

(22) Filed: Jul. 14, 2017

(65) Prior Publication Data

US 2018/0022092 A1 Jan. 25, 2018

(30) Foreign Application Priority Data

Jul. 22, 2016 (JP) ..... 2016-144380

(51) Int. Cl.

| | |
|---|---|
| ***B41J 2/135*** | (2006.01) |
| ***B41J 2/14*** | (2006.01) |
| ***B41J 2/175*** | (2006.01) |
| ***B41J 3/54*** | (2006.01) |
| ***B41J 2/165*** | (2006.01) |

(Continued)

(52) U.S. Cl.

CPC ..... *B41J 2/135* (2013.01); *B41J 2/14032* (2013.01); *B41J 2/1652* (2013.01); *B41J 2/16508* (2013.01); *B41J 2/16523* (2013.01); *B41J 2/16532* (2013.01); *B41J 2/16585* (2013.01); *B41J 2/175* (2013.01); *B41J 2/17513* (2013.01); *B41J 2/17553* (2013.01); *B41J 2/17563* (2013.01); *B41J 2/18* (2013.01); *B41J 3/543* (2013.01); *B41J 2002/0055* (2013.01); *B41J 2002/14185* (2013.01); *B41J 2002/14403* (2013.01); *B41J 2202/12* (2013.01); *B41J 2202/20* (2013.01)

(58) Field of Classification Search

CPC .. B41J 2/14032; B41J 2/16508; B41J 2/1652; B41J 2/16523; B41J 2/16532; B41J 2/16585; B41J 2/175; B41J 2/135

See application file for complete search history.

(56) References Cited

U.S. PATENT DOCUMENTS

2002/0180827 A1 12/2002 Hirota
2007/0070103 A1 3/2007 Akune et al.

(Continued)

FOREIGN PATENT DOCUMENTS

JP 2010-194767 A 9/2010
JP 2012-040725 A 3/2012

OTHER PUBLICATIONS

Extend European Search Report issued in related European Patent Application No. 17181260.5, dated Dec. 15, 2017.

*Primary Examiner* — Lamson D Nguyen
(74) *Attorney, Agent, or Firm* — Merchant & Gould P.C.

(57) ABSTRACT

There is provided a head module including: a case; and a head provided with nozzles through which a liquid is jetted. The head includes: two first inlets through which the liquid flows into the head; and a first outlet through which the liquid flows out of the head. The case includes: a second inlet through which the liquid supplied from an outside flows into the case; two inflow-connecting ports communicating with the second inlet and connected to the two first inlets; an outflow-connecting port connected to the first outlet; and a second outlet communicating with the outflow-connecting port and through which the liquid flows out to the outside.

24 Claims, 19 Drawing Sheets

(51) Int. Cl.

| | |
|---|---|
| ***B41J 2/18*** | (2006.01) |
| *B41J 2/005* | (2006.01) |

(56) References Cited

U.S. PATENT DOCUMENTS

| | | | |
|---|---|---|---|
| 2010/0220146 | A1 | 9/2010 | Menzel et al. |
| 2012/0069097 | A1 | 3/2012 | Uezawa |
| 2012/0113197 | A1 | 5/2012 | Kashu et al. |
| 2014/0104348 | A1 | 4/2014 | Owaki et al. |
| 2014/0240406 | A1 | 8/2014 | LaCaze et al. |
| 2015/0183217 | A1 | 7/2015 | Hagiwara |

HEAD MODULE, LIQUID JETTING APPARATUS INCLUDING THE SAME, AND CASE

CROSS REFERENCE TO RELATED APPLICATION

The present application claims priority from Japanese Patent Application No. 2016-144380 filed on Jul. 22, 2016, the disclosure of which is incorporated herein by reference in its entirety.

BACKGROUND

Field of the Invention

The present invention relates to a head module including a head that jets a liquid, a liquid jetting apparatus including the head module, and a case supported by the head.

Description of the Related Art

There is conventionally known a printer in which an ink is circulated between a head that jets the ink from nozzles and a tank storing the ink. In that printer, the head includes two inflow-side ink chambers connected to the nozzles and two inflow-side ports connected to the two inflow-side ink chambers. The inflow-side ports are connected to a first tank through respective first ink channels. In that printer, the head includes two outflow-side ink chambers communicating with the two inflow-side ink chambers and two outflow-side ports connected to the two outflow-side ink chambers. The outflow-side ports are connected to a second tank via respective second ink channels.

In the above printer, the ink stored in the first tank is supplied to the head from the two inflow-side ports through the respective first ink channels. In that configuration, if the two first ink channels are different in environment such as ambient temperature, the two inflow-side ink chambers may have, for example, different degrees of viscosity of ink supplied thereto. This may cause ink jetting properties to vary between the nozzle connected to one of the inflow-side ink chambers and the nozzle connected to the other of the inflow-side ink chambers. Further, when a large amount of ink is jetted from the head, the amount of ink supplied from the inflow-side ports is not enough, and thus the ink is supplied also from the outflow-side ports. Namely, the ink flows backward in the outflow-side ports. In that case, the ink is supplied to the head from mutually different tanks. The respective tanks may be different in environment such as ambient temperature, and thus the ink flowing into the head from the inflow-side ports and the ink flowing into the head from the outflow-side ports may have, for example, different degrees of viscosity of the ink.

An object of the present teaching is to provide a head module that may uniformize condition of an ink supplied to a head, a liquid jetting head, and a case.

SUMMARY

According to an aspect of the present teaching, there is provided a head module including a head and a case, the head including:

nozzles;

two first inlets through which the liquid flows into the head and which communicate with the nozzles; and a first outlet through which the liquid flows out of the head and which communicates with the two first inlets, the case including:

a second inlet through which the liquid supplied from an outside flows into the case;

two inflow-connecting ports communicating with the second inlet, each of the two inflow-connection ports being connected to one of the two first inlets;

an outflow-connecting port connected to the first outlet, and a second outlet communicating with the outflow-connecting port and through which the liquid flows out to the outside.

According to another aspect of the present teaching, there is provided a case configured to be supported by a head which includes: nozzles; two first inlets through which a liquid flows into the head and which communicate with the nozzles; and a first outlet through which the liquid flows out of the head and which communicates with the two first nozzles, the case including:

a second inlet through which the liquid supplied from an outside flows into the case;

two inflow-connecting ports communicating with the second inlet and connected to the two first inlets, each of the two inflow-connection ports being connected to one of the two first inlets;

a outflow-connecting port connected to the first outlet; and a second outlet communicating with the second communicating aperture and through which the liquid flows to the outside.

In the present teaching, a port for supplying the liquid is common to the two inflow-connecting ports, and the liquid supplied from the port for supplying the liquid flows to the two inflow-connecting ports. That configuration may uniformize the viscosity etc., of the liquid flowing into the head from one of the two inlets and the viscosity etc., of the liquid flowing into the head from the other of the two inlets.

In the present teaching, for example, when a large amount of ink is jetted from the nozzle, the liquid in the first outlet may flow backward to flow into the head therefrom. In that case, the liquid flowing into the head from the first inlet and the liquid flowing into the head from the first outlet both flow into the head after flowing through the same case. This may uniformize the viscosity etc., of the liquid flowing into the head from the first inlet and the viscosity etc., of the liquid flowing into the head from the first outlet.

BRIEF DESCRIPTION OF THE DRAWINGS

FIG. 6A is a view of the head module as seen from the upper side, wherein

FIG. 12A is a view of the case as seen from the upper side, wherein

DESCRIPTION OF THE EMBODIMENTS

In the following, an explanation will be given about an embodiment of the present disclosure.

<Overall Configuration of Printing Apparatus>

Figure 1:
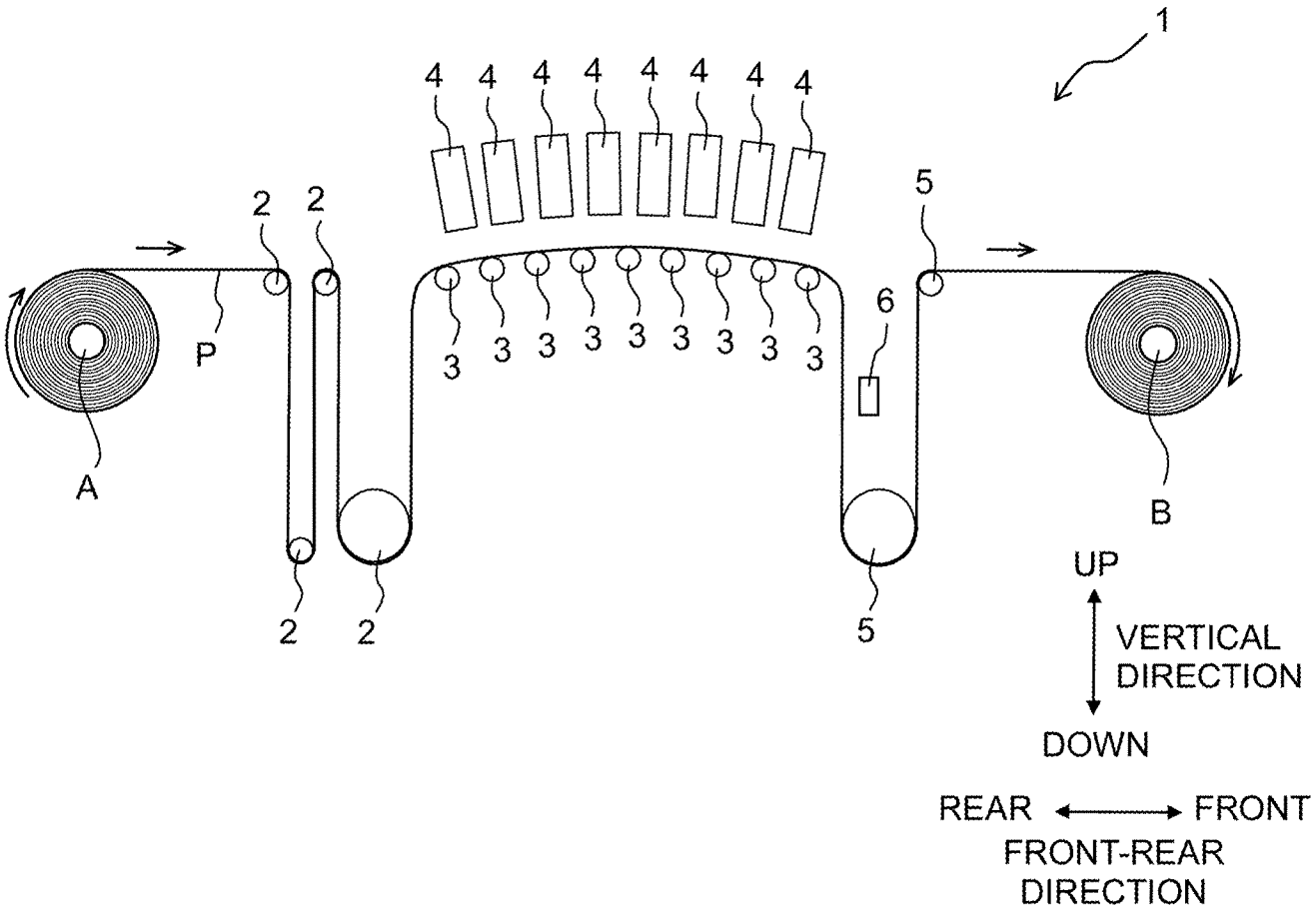
FIG. 1 is a view schematically depicting the configuration of a printing apparatus.

As depicted in FIG. 1, a printing apparatus 1 as a liquid jetting apparatus has a plurality of upstream rollers 2, nine pieces of supporting roller 3, eight pieces of line head 4, a plurality of downstream rollers 5, and a UV irradiating device 6. In the front-rear direction, the plurality of supporting rollers 3 and the eight line heads 4 are located in front of the plurality of upstream rollers 2, and the plurality of downstream rollers 5 are located in front of the plurality of supporting rollers 3 and the eight line heads 4.

The plurality of upstream rollers 2 convey a rolled paper P wound around a circular tube A. The plurality of upstream rollers 2 are apart from each other in the front-rear direction, and are apart from each other in the vertical direction. The rolled paper P is conveyed in a forward direction while being bent by the plurality of upstream rollers 2. The nine supporting rollers 3 are located in front of the plurality of upstream rollers 2 in the front-rear direction, and are arranged side by side in the front-rear direction. The nine supporting roller 3 conveys the rolled paper P, conveyed from the plurality of upstream rollers 2, in the frontward direction, while supporting the rolled paper P from therebelow.

Figure 4:
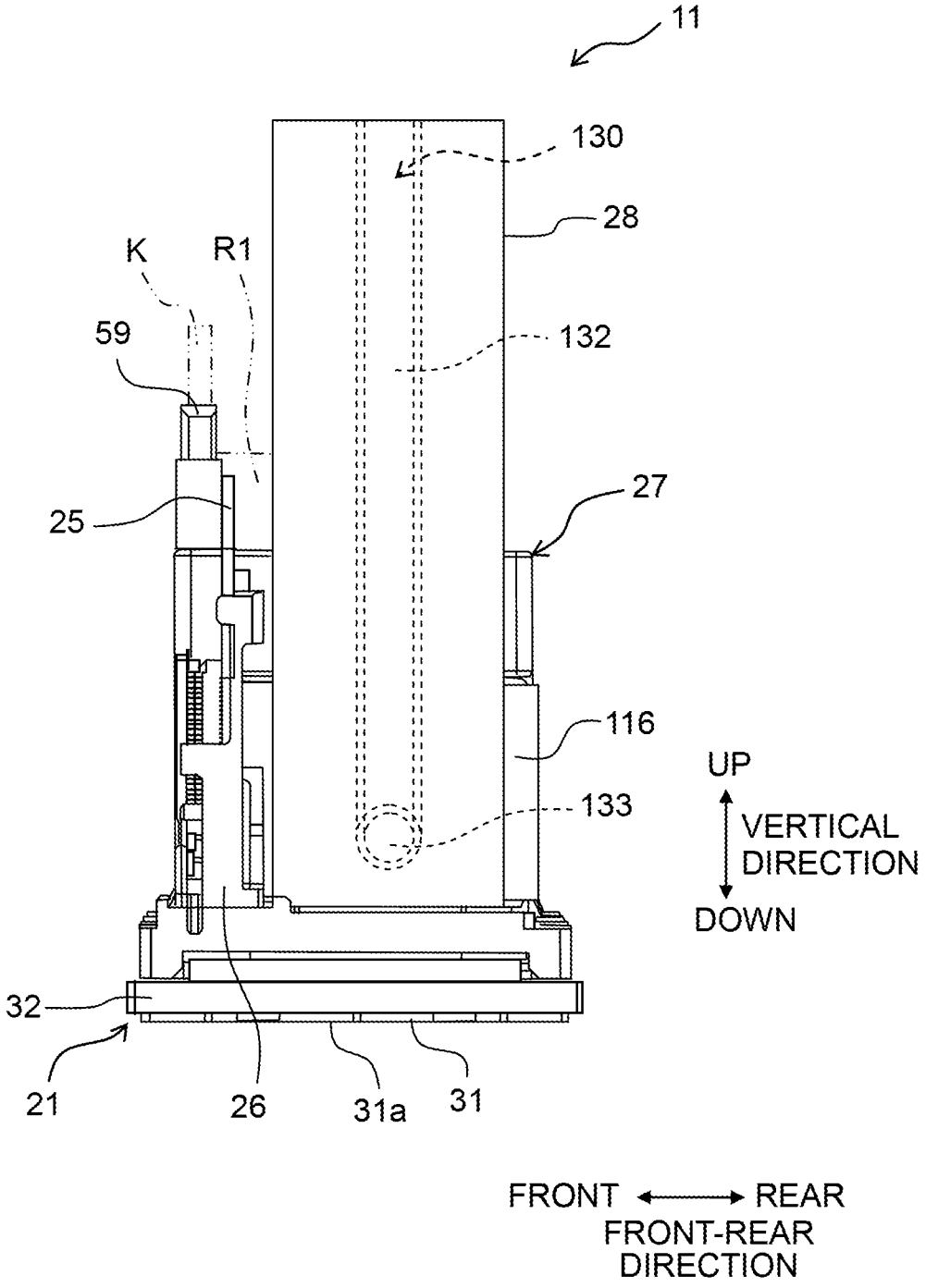
FIG. 4 is a view of the head module as seen from the right side.

The eight line heads 4 are located at a position above or over the nine supporting rollers 3, and are arranged side by side along the conveyance direction. Further, in the front-rear direction, the line heads 4 are arranged such that each one of the eight line heads 4 is located between two adjacent supporting rollers 3 among the nine supporting rollers 3. Each of the line heads 4 jets or discharges an ink from a plurality of nozzle 10 (see FIG. 2) formed in a nozzle surface 31*a* (see FIG. 4) which is the lower surface of the line head 4. With this, the ink lands on the rolled paper P conveyed by the supporting rollers 3, and an image, etc., is printed on the rolled paper P by the landed ink. Here, among the eight line heads 4, six line heads 4 on the front side jet black, yellow, cyan, magenta, orange and purple inks, respectively. Note that regarding the six line heads 4 on the front side, each of the six line heads jets one color ink. Regarding the eight line heads 4, two line heads 4 on the rear side jet white ink. Namely, the two line heads 4 on the rear side both jet one color ink that is the white ink. Further, the ink jetted from each of the line heads 4 is a UV ink which is curable by being irradiated with a ultraviolet ray. Furthermore, the white ink contains titanium oxide as a coloring material thereof.

The plurality of downstream rollers 5 are arranged in front of the nine supporting roller 3. The plurality of downstream rollers 5 convey the rolled paper P conveyed from the nine supporting rollers 3. The plurality of downstream rollers 5 are apart from each other in the front-rear direction, and are apart from each other in the vertical direction. The rolled paper P is conveyed in a forward direction while being bent by the plurality of downstream rollers 5. Further, the rolled paper P conveyed by the plurality of downstream rollers 5 is wound around by a circular tube B. The UV irradiating device 6 is located at an intermediate portion of a conveyance path or route of the rolled paper P conveyed by the plurality of downstream rollers 5, and irradiates the ultraviolet ray onto a print surface of the rolled paper P, thereby curing the UV ink on the rolled paper P.

Namely, provided that the direction in which the rolled paper P wound around the circular tube A is conveyed to the circular tube B is the conveyance direction, the circular tube A, the plurality of upstream rollers 2, the nine supporting rollers 3 (or the eight line heads 4), the UV irradiating device 6, the plurality of downstream rollers 5, and the circular tube B are arranged in this order from the upstream side toward the downstream side of the conveyance direction. Further, in the conveyance direction, the six line heads 4 which jet the black, yellow, cyan, magenta, orange, purple inks, respectively, are located on the downstream side of the two line heads 4 both of which jet the white ink. Furthermore, the eight line heads 4 face the surface of the rolled paper P which is being conveyed. Moreover, the eight supporting rollers 3 face and make contact with the rear (back) surface of the rolled paper P which is being conveyed.

<Line Head>

Figure 2:
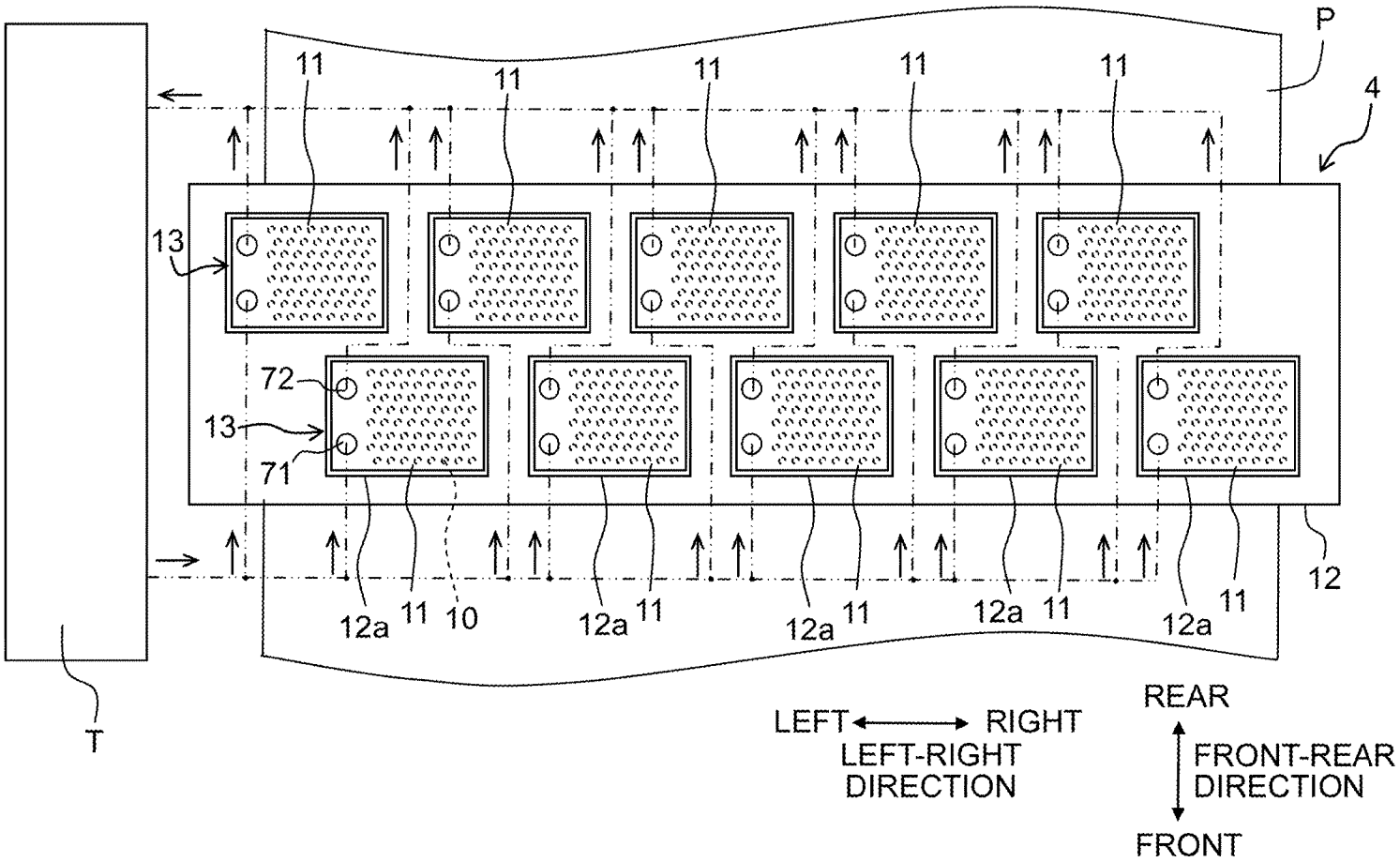
FIG. 2 is a view schematically depicting the configuration of a line head.

Next, an explanation will be given about the eight line heads 4. The eight line heads 4 have a same structure. Namely, in the following description, one of the line heads 4 will be explained. As depicted in FIG. 2, each of the line heads 4 is provided with ten pieces of head module 11, and a module holder 12. Note that in the following explanation, a direction orthogonal to the front-rear direction and the vertical direction is referred to as the left-right direction (an example of a "first direction"). Further, in the following explanation, the rightward and the leftward in the left-right direction are the right side and the left side as seen from the front side. Furthermore, since the ten head modules 11 have a same structure, one of the head modules 11 will be explained in the following description.

Each of the head modules 11 has a plurality of nozzles 10, and jets an ink from the plurality of nozzles 10, as described above. Further, the module 11 has an inflow port 71 and an outflow port 72 (which will be described later on) on a left end portion thereof. In the head module 11, the inflow port 71 and the outflow port 72 are communicated with an ink tank T by non-illustrated tubes, etc. With this, the ink supplied from the ink tank T inflows into the head module 11 from the inflow port 71. Furthermore, the ink inside the head module 11 outflows from the outflow port 72 and returns to the ink tank T. Namely, the ink circulates between the head module 11 and the ink tank T. An ink flow channel (ink channel) inside the head module 11 will be specifically explained later on. Note that although the ink tank T is depicted on the left side of the line head 4 for the sake of convenience, the position of the ink tank T may be another position, such as a position on the upper side of the line head 4, for example.

Further, five head modules 11 among the ten head modules 11 are arranged side by side in the left-right direction. A row formed by the five head modules arranged side by side in the left-right direction is referred to as a module row 13. One line head 4 has two module rows 13 arranged side by side in the front-rear direction. Further, among the two module rows 13, a module row 13 on the front side is shifted in the rightward direction with respect to another module row 13 on the rear side. With this, the ten head modules 11 are aligned or arranged in the entire length in the left-right direction of the rolled paper P. Namely, the ten head modules 11 are arranged in the staggered manner with respect to one another in the left-right and front-rear directions. Module holder 12 extends in the left-right direction over the entire width of the rolled paper P. The module holder 12 has a plurality of accommodating sections 12*a* in which the head modules 11 are accommodated, respectively. The head modules 11 are installed in or attached to the module holder 12 by being inserted into the accommodating sections 12*a*, respectively, from therebelow. Namely, in the present embodiment, the vertical direction is an attaching/detaching direction in which the head modules 11 are attached/detached with respect to the printing apparatus 1. Further, the plurality of head modules 11 are accommodated in the accommodating sections 12*a*, respectively, thereby allowing the plurality of head modules 11 to be held (maintained) in the above-described positional relationship by the module holder 12.

<Head Module>

Next, the configuration of the head modules 11 will be explained, with reference to the drawings. As depicted in FIGS. 3 to 7 (see, in particular, FIGS. 3 and 7), each of the head modules 11 is provided with a head 21, a COF substrate 22, a heat spreader (heat radiator) 23, a flexible substrate 24, a rigid substrate 25, a substrate holder 26, a case 27 and a cooler 28.

<Head>

Figure 7:
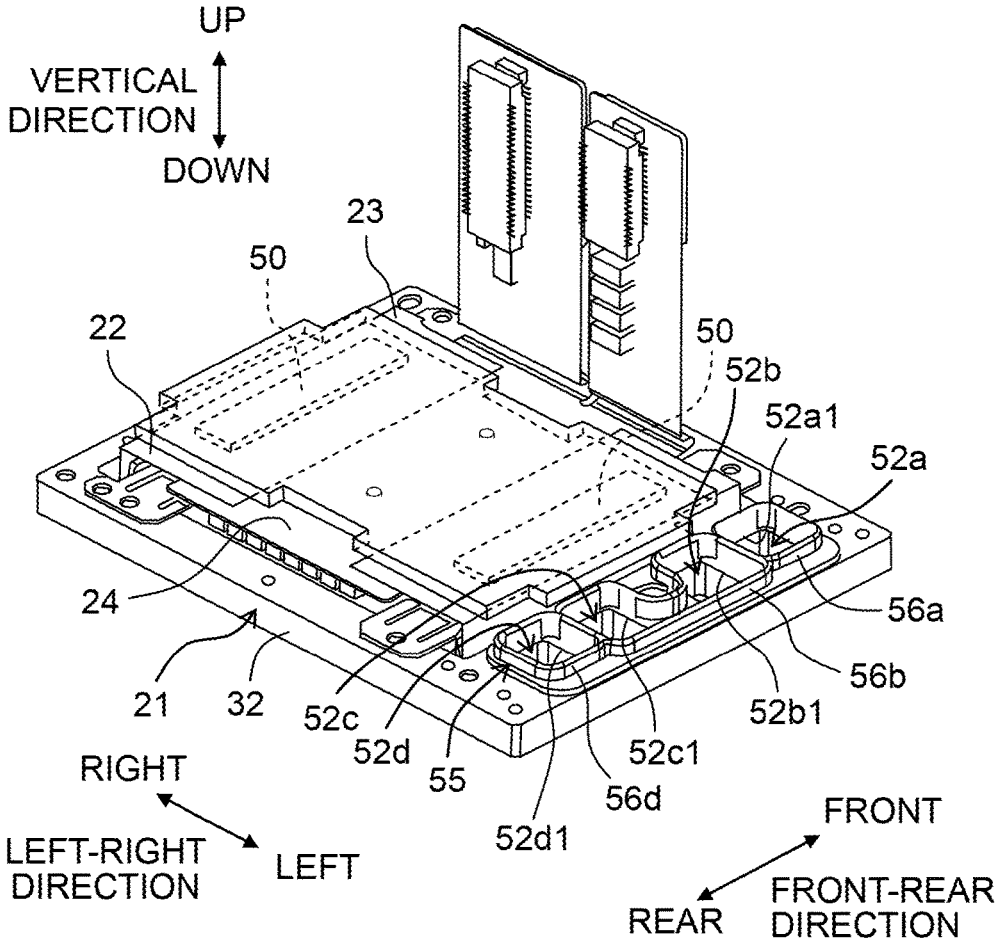
FIG. 7 is a perspective view of a head, a COF substrate, a sealer and a flexible substrate.
Figure 8:
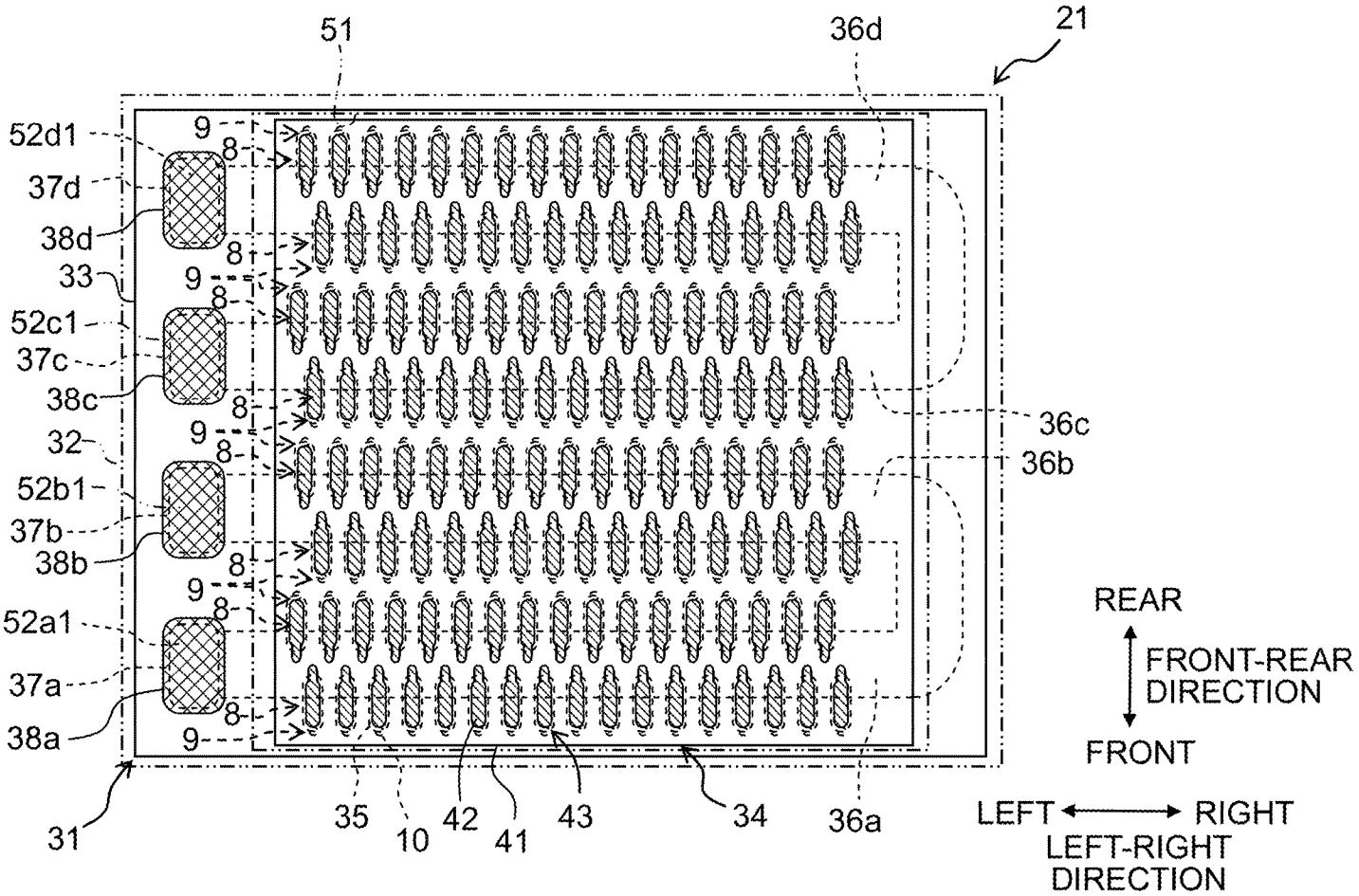
FIG. 8 is a plane view of a head chip.
Figure 9:
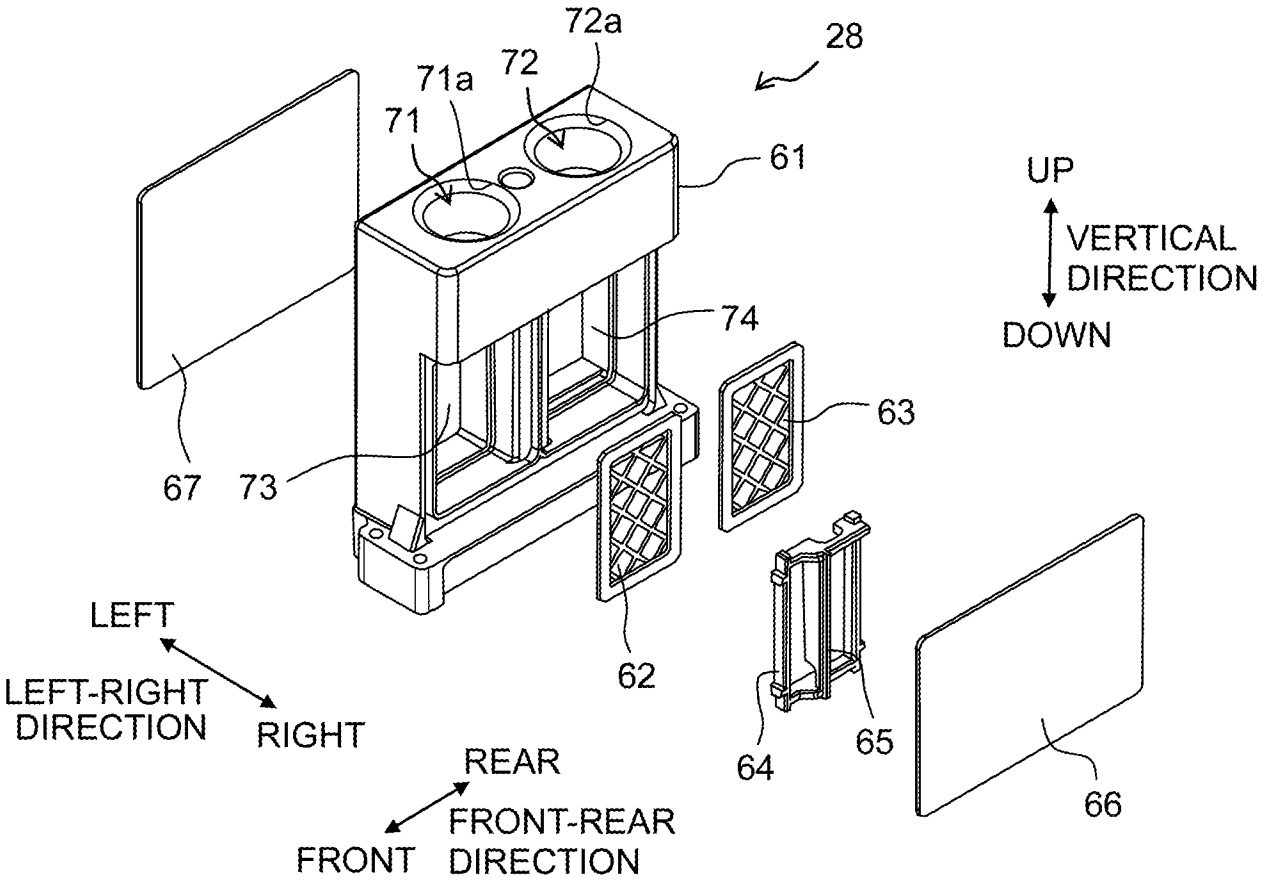
FIG. 9 is an exploded perspective view of a case.

As depicted in FIGS. 7 and 8, the head 21 is provided with a head chip 31 and a head holder 32. The head chip 31 has a substantially rectangular parallelepiped shape in which lengths in the left-right direction and in the front-rear direction are longer than that in the vertical direction, and the length in the left-right direction is longer than the length in the front-rear direction. As depicted in FIG. 8, the head chip 31 is provided with a channel forming member 33 and a piezoelectric actuator 34. The channel forming member 33 has ink channels such as a plurality of nozzles 10, a plurality of pressure chambers 35, four manifold channels 36*a* to 36*d*, etc.

The plurality of nozzles 10 are formed in the nozzle surface 31*a* (see FIG. 5) that is the lower surface of the head chip 31. As depicted in FIG. 8, the nozzle surface 31*a* has a length in the left-right direction which is longer than that in the front-rear direction. Namely, the left-right direction is the longitudinal direction of the nozzle surface 31*a*, and the front-rear direction is the short direction of the nozzle surface 31*a*. The plurality of nozzles 10 are aligned in the left-right direction to thereby form a nozzle row 9. The head chip 31 has eight pieces of the nozzles row 9 which are arranged side by side in the front-rear direction.

Each of the pressure chambers 35 is present corresponding to one of the nozzles 10. Namely, the plurality of pressure chambers 35 are present individually corresponding to the plurality of nozzles 10, respectively. The plurality of pressure chambers 35 are located at positions above the plurality of nozzles 10, respectively. Each of the plurality of pressure chambers 35 has a substantially elliptical planar shape. Further, pressure chambers 35, which are included in the plurality of pressure chambers 35 and which correspond to nozzles 10, among the plurality of nozzles 10, forming an odd-numbered nozzle row 9 from the front, overlap with the nozzles 10 in the vertical direction at front end portions of the pressure chambers 35, respectively, and are connected to the nozzles 10 via non-illustrated descender channels. On the other hand, pressure chambers 35, which are included in the plurality of pressure chambers 35 and which correspond to nozzles 10, among the plurality of nozzles 10, forming an even-numbered nozzle row 9 from the front, overlap with the nozzles 10 in the vertical direction at rear end portions of the pressure chambers 35, respectively, and are connected to the nozzles 10 via non-illustrated descender channels.

The four manifold channels 36*a* to 36*d* are located between the plurality of nozzles 10 and the plurality of pressure chambers 35 in the vertical direction. The manifold channel 36*a* is located between first and second nozzle rows 9 from the front in the front-rear direction, and extends in the left-right direction over pressure chambers 35, among the plurality of pressure chambers 35, corresponding to these two nozzle rows 9. Further, the manifold channel 36*a* and the pressure chambers 35 corresponding to the first and second nozzle rows 9 from the front are connected via non-illustrated individual throttle channels, etc., respectively. Furthermore, the manifold channel 36*a* extends up to a left end portion of the channel forming member 33, and has an opening 37*a* which in open in the upper surface of the channel forming member 33.

The manifold channel 36*b* is located between third and fourth nozzle rows 9 from the front in the conveyance (front-rear) direction, and extends in the left-right direction over pressure chambers 35, among the plurality of pressure chambers 35, corresponding to these two nozzle rows 9. Further, the manifold channel 36*b* and the pressure chambers 35 corresponding to the third and fourth nozzle rows 9 from the front are connected via non-illustrated individual throttle channels, etc., respectively. Furthermore, the manifold channel 36*b* extends up to the left end portion of the channel forming member 33, and has an opening 37*b* which in open in the upper surface of the channel forming member 33. Moreover, a right end portion of the manifold channel 36*a* and a right end portion of the manifold channel 36*b* are connected to each other.

The manifold channel 36*c* is located between fifth and sixth nozzle rows 9 from the front in the conveyance (front-rear) direction, and extends in the left-right direction over pressure chambers 35, among the plurality of pressure chambers 35, corresponding to these two nozzle rows 9. Further, the manifold channel 36*c* and the pressure chambers 35 corresponding to the fifth and sixth nozzle rows 9 from the front are connected via non-illustrated individual throttle channels, etc., respectively. Furthermore, the manifold channel 36*c* extends up to the left end portion of the channel forming member 33, and has an opening 37*c* which in open in the upper surface of the channel forming member 33.

The manifold channel 36*d* is located between seventh and eighth nozzle rows 9 from the front in the conveyance (front-rear) direction, and extends in the left-right direction over pressure chambers 35, among the plurality of pressure chambers 35, corresponding to these two nozzle rows 9. Further, the manifold channel 36*d* and the pressure chambers 35 corresponding to the seventh and eighth nozzle rows 9 from the front are connected via non-illustrated individual throttle channels, etc., respectively. Furthermore, the manifold channel 36*d* extends up to the left end portion of the channel forming member 33, and has an opening 37*d* which in open in the upper surface of the channel forming member 33. Moreover, a right end portion of the manifold channel 36*c* and a right end portion of the manifold channel 36*d* are connected to each other.

Further, the openings 37*a* to 37*d* in the upper surface of the channel forming member 33 are covered by filters 38*a* to 38*d*, respectively. The filters 38*a* to 38*d* are configured to prevent any foreign matter or substance in the ink, etc., from flowing from the openings 37*a* to 37*d* to the manifold channels 36*a* to 36*d*, respectively. Note that since the case 27 has filters 62 and 63 and that the foreign matter in the ink, etc., is captured mainly by the filters 62 and 63, as will be described later on, it is allowable that the filters 38*a* to 38*d* are omitted.

The piezoelectric actuator 34 is located on the upper surface of the channel forming member 33. The piezoelectric actuator 34 is configured to change the volumes of the pressure chambers 35. By changing the volume of a certain pressure chamber 35 included in the plurality of pressure chambers 35, pressure is applied to the ink inside the certain pressure chamber 35. By applying the pressure to the ink inside the certain pressure chamber 35, the ink is jetted from a nozzle 10 included in the plurality of nozzles 10 and corresponding to and communicated with the certain pressure chamber 35. Here, as depicted in FIG. 8, the piezoelectric actuator 34 is provided with a piezoelectric layer 41, a plurality of individual electrodes 42, etc. The piezoelectric layer 41 extends over the plurality of pressure chambers 35. Each of the plurality of individual electrodes 42 is present corresponding to one of the pressure chambers 35. Namely, the plurality of individual electrodes 42 are present to individually correspond to the plurality of pressure chambers 35, respectively. Each of the individual electrodes 42 overlaps with a central portion of one of the pressure chambers 35. Further, the plurality of individual electrodes 42 are located on the upper surface of the piezoelectric layer 41. A portion, of the piezoelectric layer 41, in which each of the individual electrodes 42, the piezoelectric layer 41 and the central portion of one of the pressure chambers 35 overlap with one another in the vertical direction, is a driving element 43. Namely, the number of the driving element 43 is same as the number of the plurality of individual electrodes 42 (or of the plurality of nozzles 10). Note that the configuration of the piezoelectric actuator 34 itself is publicly known, and thus any detailed explanation therefor will be omitted.

The head holder 32 (see a two-dot chain line in FIG. 8) is a metallic frame having a substantially rectangular parallelepiped shape. The head holder 32 has lengths in the front-rear direction and in the left-right direction which are longer than that in the vertical direction, and thickness along the vertical direction. Further, the head holder 32 has the lengths in the front-rear direction and in the left-right direction which are longer than those of the head chip 31 to some extent. Further, similarly to the head chip 31, the head holder 32 also has the length in the left-right direction which is longer than the length in the front-rear direction. The head holder 32 is located on the upper surface of the head chip 31. The head holder 32 is formed with a substantially rectangular through hole 51 (see a two-dot chain line in FIG. 8). The through hole 51 is positioned at a location closer to the right side of the head holder 32. The piezoelectric layer 41 and the plurality of individual electrodes 42 are exposed from the through hole 51. Further, through holes 52*a* to 52*d* are formed in a left end portion of the head holder 32. The through hole 52*a* overlaps with the opening 37*a*, the through hole 52*b* overlaps with the opening 37*b*, the through hole 52*c* overlaps with the opening 37*c*, and the through hole 52*d* overlaps with the opening 37*d*, in the vertical direction. Further, openings at the upper end of the through holes 52*a* and 52*d* are inlets 52*a*1 and 52*d*1 (see FIG. 7), respectively, via which the ink inflows into the head 21. Furthermore, openings at the upper end of the through holes 52*b* and 52*c* are outlets 52*b*1 and 52*c*1 (see FIG. 7), respectively, via which the ink flows out of the head 21. With this, in the head 21, the inlets 52*a*1, 52*d*1 and the outlets 52*b*1, 52*c*1 are arranged side by side with respect to the plurality of nozzles 10 in the left-right direction.

As depicted in FIG. 7, a sealer 55 is located in the upper surface of the left end portion of the head holder 32. The sealer 55 is a co-called packing formed of a rubber material, etc. The sealer 55 extends in the front-rear direction over the through holes 52*a* to 52*d*. The sealer 55 has a seal portion 56*a* and a seal portion 56*d* at portions thereof which overlap with the through hole 52*a* and the through hole 52*d*, respectively. The seal portions 56*a* and 56*d* each have a cylindrical shape extending in the vertical direction. The seal portion 56*a* is connected to the inlet 52*a*1, and the seal portion 56*d* is connected to the inlet 52*d*1. Further, the sealer 55 has a seal portion 56*b* at a portion thereof which spans over the through hole 52*b* and the through hole 52*c*. The seal portion 56*b* has a cylindrical shape extending in the vertical direction, and is connected to the two outlets 52*b*1 and 52*c*1. Note that the head holder 32 and the sealer 55 is adhered to each other with, for example, a silicone-based adhesive.

<COF Substrate>

As depicted in FIG. 7, the COF substrate 22 has flexibility, and is connected to the plurality of individual electrodes 42 by being joined to the upper surface of the piezoelectric layer 41. Further, the COF substrate 21 is drawn to the both sides in the left-right direction from a joining portion, at which the COF substrate is joined to the piezoelectric layer 41, and is bent upwardly at these drawn portions. Further, forward end portions, of the COF substrate 21, of the two portions which are drawn to the both sides in the left-right direction, are located immediately above the piezoelectric layer 41. Two driver ICs are mounted respectively on these forward end portions of the two portions, of the COF substrate 21, which are drawn to the both sides in the left-right direction (see FIG. 7). The two driver ICs 50 are each elongated in the front-rear direction, and are arranged side by side in the left-right direction. The driver ICs 50 are configured to drive the piezoelectric actuator 34 (the plurality of driving elements 34).

<Heat Spreader>

Figure 6A:
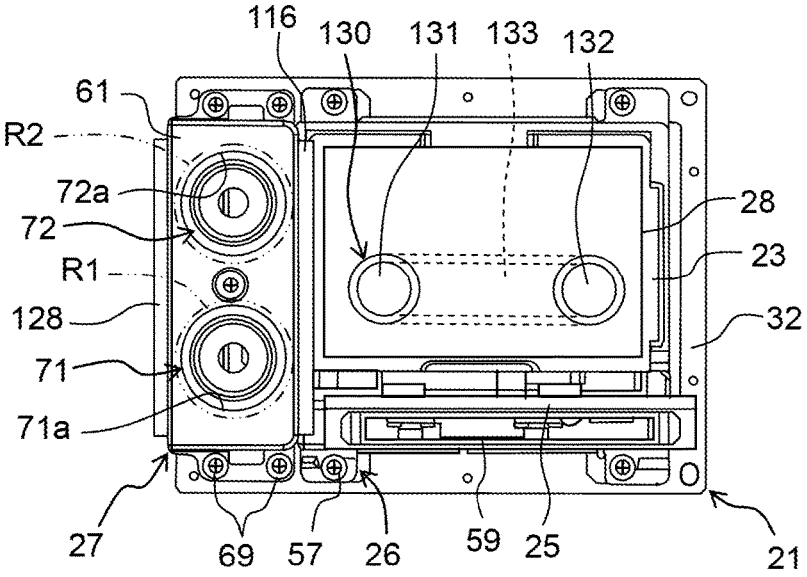
Figure 6B:
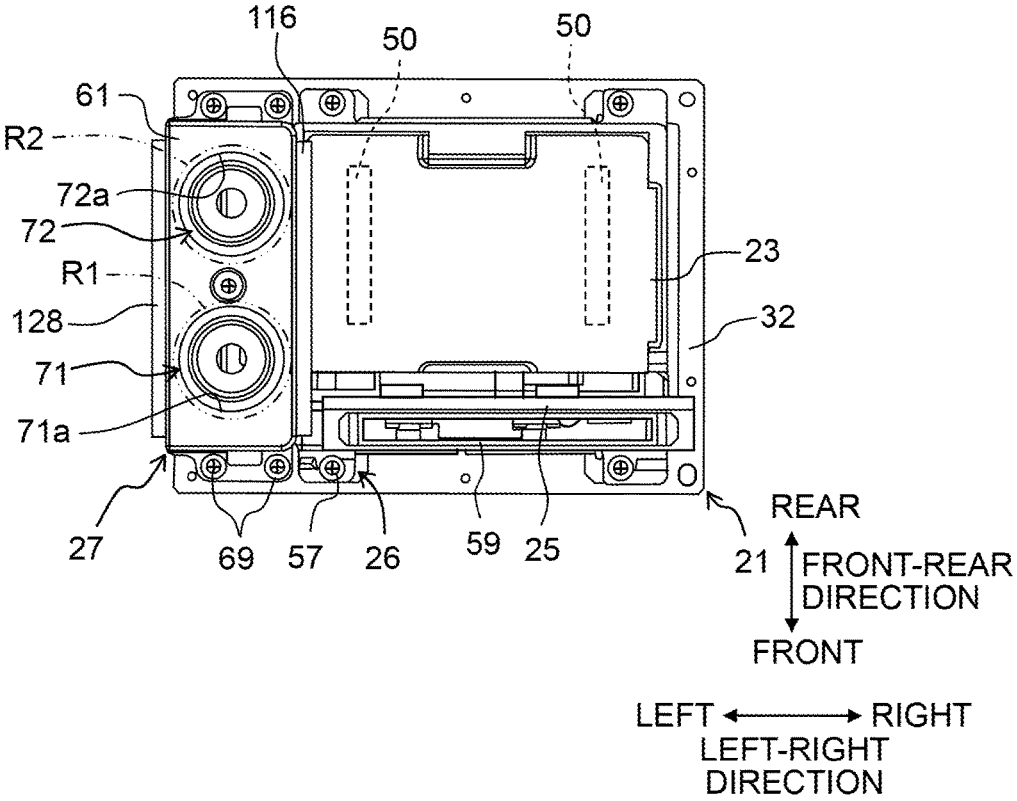
FIG. 6B is a view of the head module of FIG. 6A from which a cooler is removed.

As depicted in FIGS. 6A, 6B and 7, the heat spreader 23 is a plate made of a metallic material, etc. The heat spreader 23 extends over the two driver ICs at a location above the COF substrate 22. Namely, in the vertical direction, the driver ICs 50 are located between the heat spreader 23 and the head 21. Further, the heat spreader 23 makes contact with the two driver ICs 50.

<Flexible Substrate>

The flexible substrate 24 is a FPC (Flexible Printed Circuit) having flexibility. As depicted in FIG. 7, the flexible substrate 24 is connected to the two forward end portions of the COF substrate 22. The flexible substrate 24 extends frontwardly from connection portions at which the flexible substrate 24 make contact with the COF substrate 22, and is bent upwardly from a location at which the flexible substrate 24 overlaps with a forward end portion of the head holder 32 in the vertical direction. Further, as depicted in FIG. 3, an upper end portion of the flexible substrate 24 is connected to the rigid substrate 25.

<Rigid Substrate, Substrate Holder>

The rigid substrate 25 is configured to transmit or send a control signal, etc., to the two driver ICs 50, and is constructed to have a substantially rectangular parallelepiped shape. In the rigid substrate 25, the length in the vertical direction is the longest, and the length in the front-rear direction is the shortest. Namely, the thickness of the rigid substrate 25 is along the front-rear direction. Further, as depicted in FIGS. 6A and 6B, the rigid substrate 25 is located on the front side relative to (in front of) the heat spreader 23, and the rigid substrate 25 and the heat spreader 23 are arranged side by side in the front-rear direction. Furthermore, the rigid substrate 25 is positioned with a spacing distance with respect to the heat spreader 23 in the front-rear direction, and does not overlap with the heat spreader 23 in the vertical direction. Moreover, the rigid substrate 25 has a connector 59 (an example of a "second connector") on an upper end portion of the rigid substrate 25. The connector 59 is connected to a connector K which is located in the inside of the accommodating section 12*a*. Namely, the connector 59 is configured to electrically connect the rigid substrate 25 to the printing apparatus 1.

Figure 3:
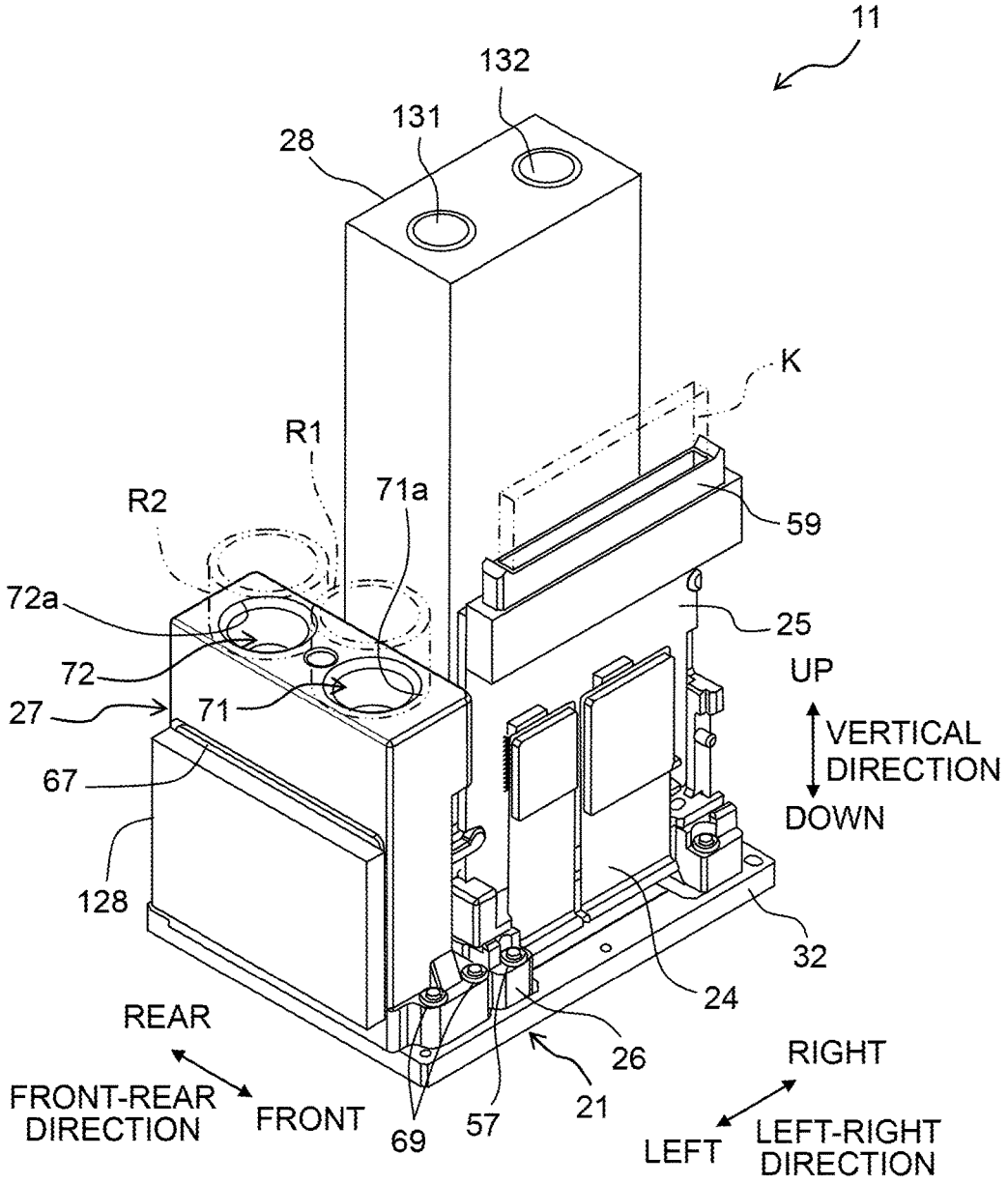
FIG. 3 is a perspective view of a head module.

As depicted in FIG. 3, the substrate holder 26 is fixed to the upper surface of the head holder 32 with a screw 57, and supports the rigid substrate 25. With this, a lower end portion of the rigid substrate 25 is supported by the head holder 32. Here, as depicted in FIGS. 6A and 6B, the rigid substrate 25 and the substrate holder 26 are overlapped with the head holder 32 as seen from the vertical direction, and do not protrude from (beyond) the head holder 32 in any of the front-rear direction and the left-right direction. With this, the rigid substrate 25 is supported by the head holder 32 within a projected plane of the head holder 32 in the vertical direction.

<Case>

The case 27 is formed to have a substantially rectangular parallelepiped shape, as depicted in FIGS. 3 to 6A, 6B. In the case 27, the lengths thereof are longer in an ascending order of: the length in the left-right direction, the length in the front-rear direction, and the length in the vertical direction. Further, the case 27 has the length in the front-rear direction which is substantially same as that of the head holder 32. Furthermore, the case 27 has the length in the left-right direction which is shorter than that in the head holder 32. Moreover, the case 27 has the length in the vertical direction which is longer than that of the head 32. Further, the case 27 is located on the upper surface of the left end portion of the head holder 32, and is overlapped in the vertical direction with the inlets 52*a*1 and 52*d*1 and with the outlets 52*b*1 and 52*c*1. With this, the inlets 52*a*1, 52*d*1 and the outlets 52*b*1, 52*c*1 are arranged side by side with the case 27 in the vertical direction. Furthermore, as depicted in FIGS. 6A and 6B, the case 27 and the heat spreader 23 are arranged side by side in the left-right direction, and the case 27 and the rigid substrate 25 are arranged side by side in the left-right direction.

As depicted in FIGS. 3 to 6A, 6B and FIGS. 9 to 15, the case 27 is provided with a case body 61, two filters 62 and 63, a frame 64, and two metallic plates 66 and 67. The case body 61 is a member having a substantially rectangular parallelepiped shape and formed of a synthetic resin material, and is fixed to the upper surface of the head holder 32 with screws 69.

Further, the case body 61 has an inflow port 71, an outflow port 72, two filter chambers 73 and 74, a heating chamber 75, a connecting channel 76, two connecting apertures for inflow 77*a* and 77*b*, and one connecting aperture for outflow 78.

As depicted in FIG. 3, the inflow port 71 is positioned at a front location in an upper portion of the case body 61. The inflow port 71 has an inlet 71*a* which is open in the upper surface of the case body 61. The inflow port 71 is connected to a connector R1 located in the inside of the accommodating section 12*a*. The connector R1 is communicated with the ink tank T via a non-illustrated tube. Namely, the inflow port 71 is connected to the ink tank T via the connector R1 and the non-illustrated tube.

As depicted in FIG. 3, the outflow port 72 is positioned at a rear location in the upper portion of the case body 61. The outflow port 72 has an outlet 72*a* which is open in the upper surface of the case body 61. The outflow port 72 is connected to a connector R2 located in the inside of the accommodating section 12*a*. The connector R2 is communicated with the ink tank T via a non-illustrated tube. Namely, the outflow port 72 is connected to the ink tank T via the connector R2 and the non-illustrated tube. Further, by positioning the inflow port 71 at the front location in the upper portion of the case body 61 and by positioning the outflow port 72 at the rear location in the upper portion of the case body 61, the inlet 71*a* and the outlet 72*a* are arranged side by side in the front-rear direction in the upper surface of the case body 61. Note that in this embodiment, any one or both of the inflow port 71 and the outflow port 72 is/are an example of a "first connector".

Figure 10:
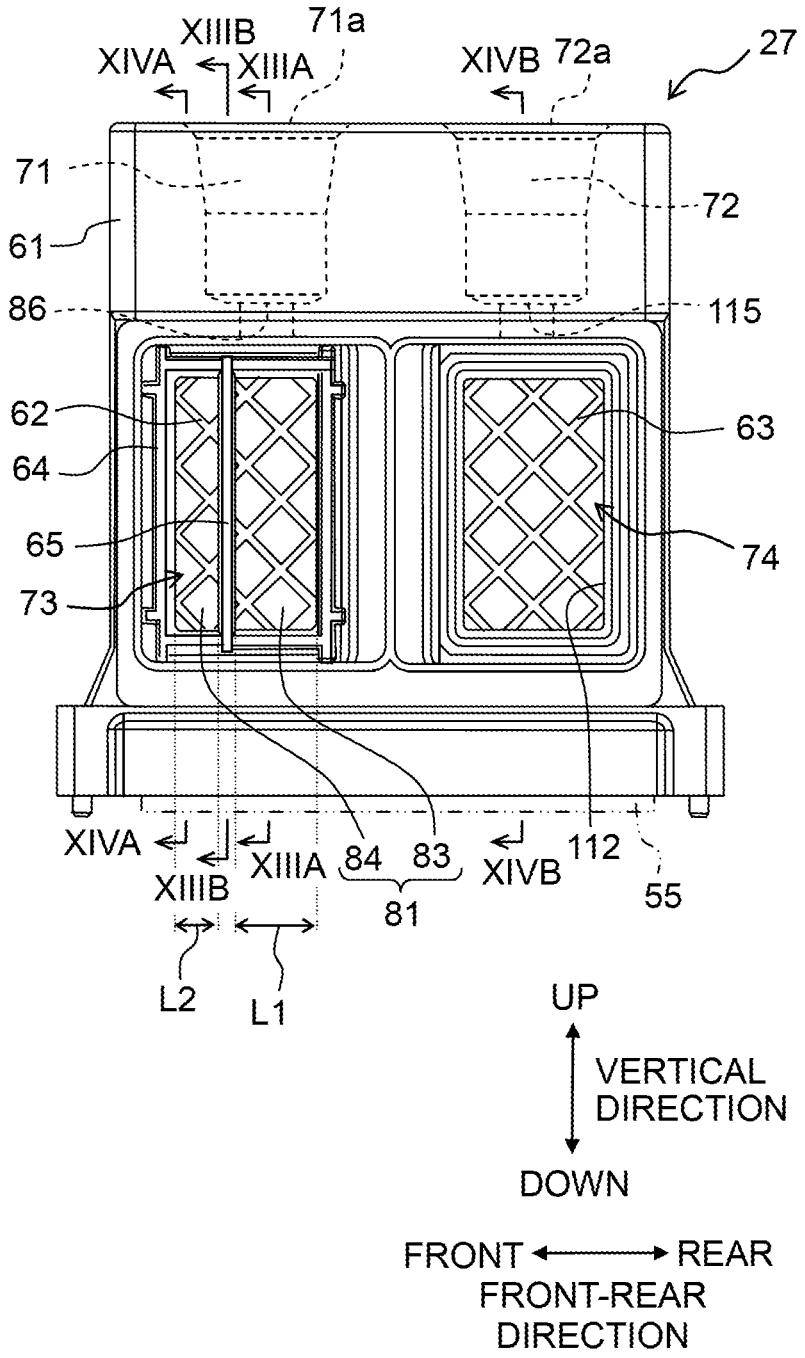
FIG. 10 is a view of the case as seen from the right side in a state that a metallic plate is removed from the case.

The filter chamber 73 is located at a position below the inflow port 71, and is connected to the inflow port 71. The filter 62 and the frame 64 are accommodated in the filter chamber 73, as depicted in FIG. 10. The filter 62 extends in the vertical direction, and has a filtering surface which is orthogonal to the left-right direction. Here, the term "filtering surface" means a surface formed with a large number of fine or minute holes (namely, mesh holes) for allowing an ink to pass therethrough. Further, the phrase that the "filtering surface (which) is orthogonal to the left-right direction" means that the direction in which the ink flows in the mesh holes is parallel to the left-right direction. Note that the filtering surface is not limited to or restricted by being orthogonal to the left-right direction, and may be inclined to some extent with respect to a plane orthogonal to the left-right direction.

Figure 13B:
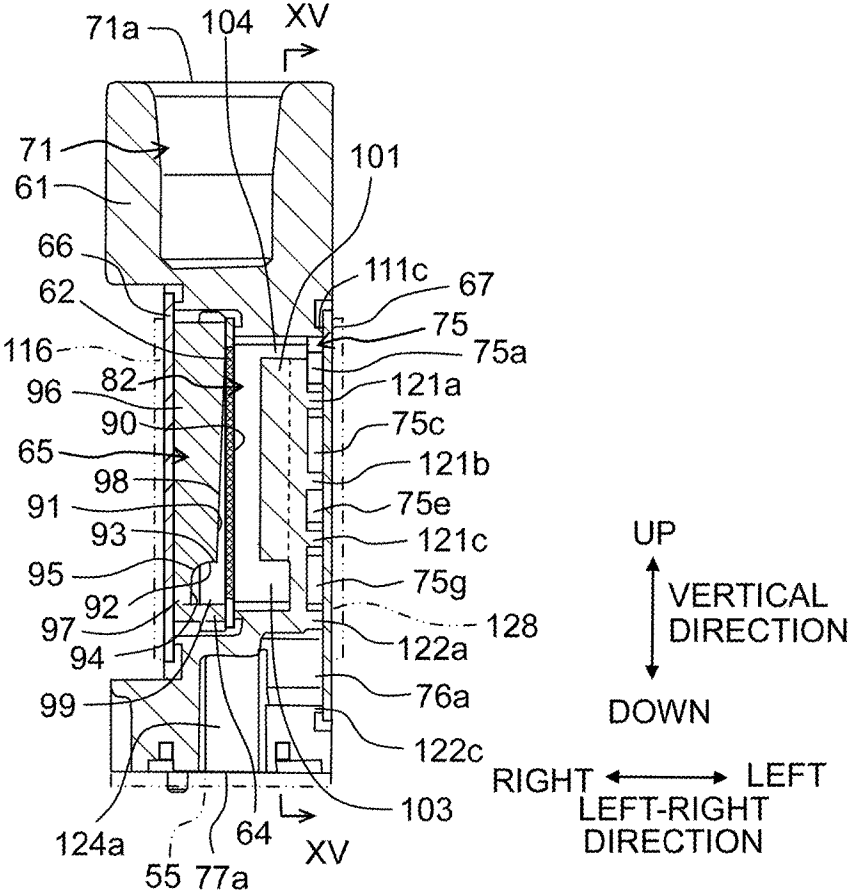
FIG. 13B is a cross-sectional view of FIG. 10 taken along a line XIIIB-XIIIB of FIG. 10, in the state that the metallic plate is attached.
Figure 13A:
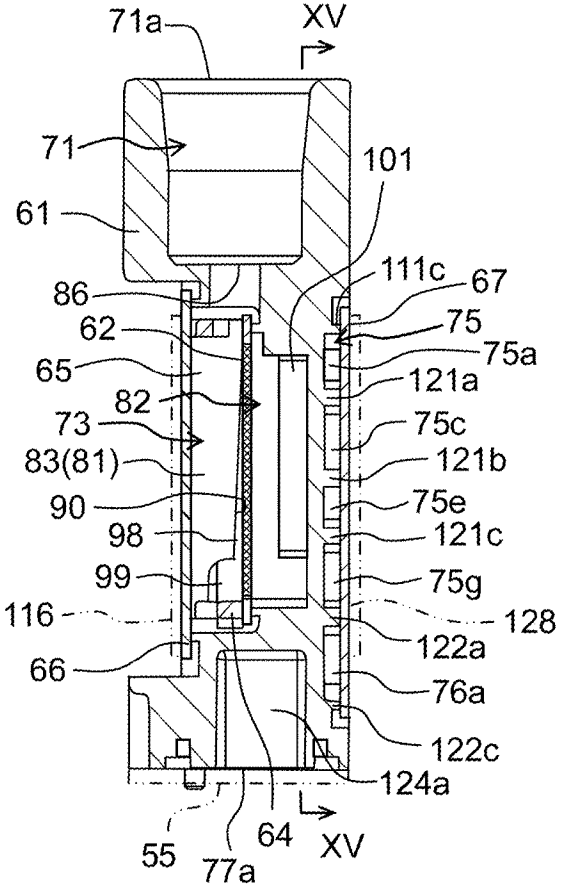
FIG. 13A is a cross-sectional view of FIG. 10 taken along a XIIIA-XIIIA line of FIG. 10, in a state that the metallic plate is attached.

As depicted in FIG. 13A, in the filter chamber 73, a portion on the right side relative to the filter 62 (on the upstream side in the flow of the ink relative to the filter 62) is an inflow liquid chamber 81, and a portion on the left side relative to the filter 62 (on the downstream side in the flow of the ink relative to the filer 62) is an outflow liquid chamber 82. The frame 64 is a frame having a substantially rectangular shape and is formed of a synthetic resin material. As depicted in FIG. 13A, the frame 64 is arranged in the inside of the liquid inflow chamber 81. Further, the filter 62 is fixed to the case body 61 and to a rear surface of the frame 64.

As depicted in FIG. 10, the frame 64 has a first wall 65. The first wall 65 extends in the vertical direction in the inflow liquid chamber 81, and both end portions in the vertical direction of the first wall 65 are supported by the frame 64. Owing to the presence of the first wall 65, a portion, in the inflow liquid chamber 81, on the rear side relative to the first wall 65 is a first liquid chamber 83; and a portion, in the inflow liquid chamber 81, on the front side relative to the first wall 65 is a second liquid chamber 84. As depicted in FIG. 10, an inlet aperture 86 via which the ink inflows into the first liquid chamber 83 is formed in an upper end portion of the first liquid chamber 83. The inlet 86 is connected to the inflow port 71. The first wall 65 is located, in the front-rear direction, at a position in front of (on the front side relative to) the center of the inflow liquid chamber 81. With this, a length L2 in the front-rear direction of the second liquid chamber 84 is shorter than a length L1 in the front-rear direction of the first liquid chamber 83. Here, the length in the left-right direction of the inflow chamber 81 is substantially constant regardless of the position in the vertical direction. Accordingly, a cross section, of the second liquid chamber 84, which is orthogonal to the vertical direction, is smaller than a cross section, of the first liquid chamber 83, which is orthogonal to the vertical direction.

Further, as depicted in FIGS. 13A and 13B, a left edge 90, of the first wall 65, which faces the filter 62 has a first side 91 and a second side 92. The first side 91 extends downwardly from the upper end of the first wall 65. Further, the first side 91 is inclined with respect to the vertical direction such that the first side 91 is located more rightwardly as the first side extends further downwardly. Namely, the first side 91 is separated away from the filter 63 in the left-right direction to a progressively greater extent as the first side 65 extends further downwardly.

The second side 92 extends in the left-right direction, and a left end of the second side 92 is connected to a lower end of the first side 91. Note that a point at which the first side 91 and the second side 92 are connected to each other (the lower end of the first side 91, the left end of the second side 92) is a point of intersection 93 between the first side 91 and the second side 92. Further, in the left edge 90, a third side 94 is positioned at a location below the second side 92. The third side 94 extends in the vertical direction up to a lower end of the left edge 90. Furthermore, a curbed portion 95 which is curbed so as to project toward the inner side of the first wall 65 and which connects the right end of the second side 92 and the upper end of the third side 94 is located between the second side 92 and the third side 94.

Moreover, owing to the edge 90 of the first wall 95 having the above-described configuration, a gap 98 is defined between the filter 62 and a first area 96, of the first wall 65, which is located above the intersection point 93, and a gap 99 is defined between the filter 62 and a second area 97, of the first wall 65, which is located below the intersection point 93. Namely, the first wall 65 is separated away from the filter 62 with a spacing distance therefrom in the left-right direction, at the first area 96 and the second area 97. Further, in the second area 97, the spacing distance in the left-right direction is greater than that in the first area 96. Here, in the vertical direction, the second area 97 is located at a position below the center of the first wall 65. Further, in the vertical direction, the height of the second area 97 is preferably about one third the height of the first wall 65.

Furthermore, a cross-sectional area S3 of a cross section, of the gap 99 between the second area 97 and the filter 62, which is orthogonal to the front-rear direction is smaller than the cross-sectional area S1 of the cross section, of the first liquid chamber 83, which is orthogonal to the vertical direction and the cross-sectional area S2 of the cross section, of the second liquid chamber 84, which is orthogonal to the vertical direction.

As depicted in FIGS. 13A and 13B, a second wall 101 is formed in a wall surface, of the outflow liquid chamber 82, which faces the filter 63 in the left-right direction. The second wall 101 projects along the left-right direction, and is separated away from the filter 63 in the left-right direction. Namely, the second wall 101 projects toward the filter 63, and a forward end portion of the second wall 101 is separated away from the filter 63.

A lower end of the second wall 101 is located at a position above the lower end of the outflow liquid chamber 82. Namely, the second wall 101 is located at a position above the lower end of the liquid outflow chamber 82 with a spacing distance from the lower end. With his, a gap 103 is defined between the second wall 101 and the lower end of the liquid outflow chamber 82; the gap 103 communicates a front portion, of the outflow liquid chamber 82, located on the front side relative to the second wall 101 and a rear portion, of the liquid outflow chamber 82, which is located on the rear side relative to the second wall 101.

The upper end of the second wall 101 is located at a position below the upper end of the outflow liquid chamber 82. Namely, the second wall 101 is located at the position below the upper end of the outflow liquid chamber 82, with a spacing distance therefrom. With this, a gap 104 is defined between the second wall 101 and the upper end of the liquid outflow chamber 82; the gap 104 communicates the front portion, of the outflow liquid chamber 82, located on the front side relative to the second wall 101 and the rear portion, of the liquid outflow chamber 82, which is located on the rear side relative to the second wall 101.

Figure 15:
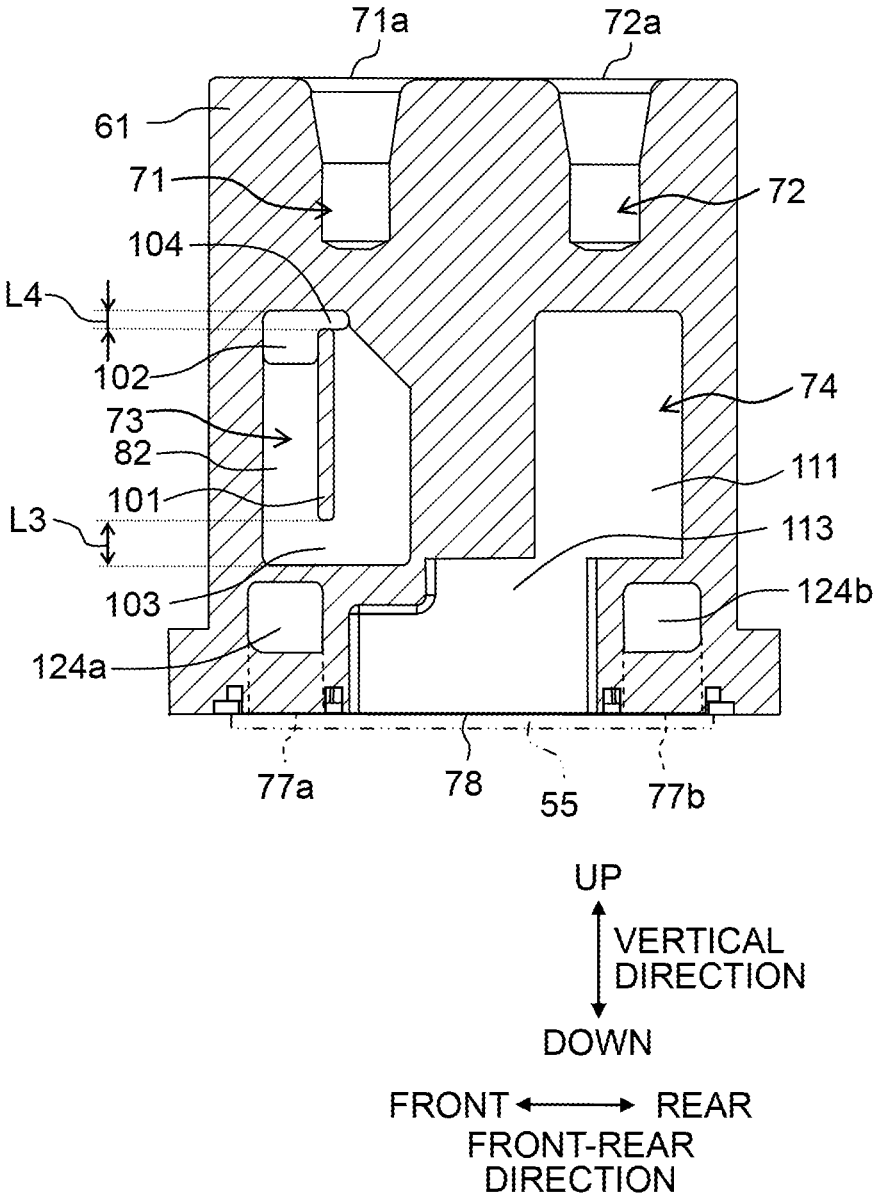
FIG. 15 is a view of FIGS. 13A, 13B, 14A and 14B taken along a XV-XV line thereof.

Further, as depicted in FIG. 15, a length L4 in the vertical direction between the upper end of the second wall 101 and the upper end of the outflow liquid chamber 82 (the length in the vertical direction of the gap 104) is shorter than a length L3 of the spacing distance between the lower end of the second wall 101 and the lower end of the outflow liquid chamber 82 (the length in the vertical direction of the gap 103). Here, the length in the left-right direction of the liquid outflow chamber 82 is substantially constant regardless of the position in the front-rear direction. Accordingly, a cross section of the gap 104, which is orthogonal to the front-rear direction is greater than a cross section, of the gap 103, which is orthogonal to the front-rear direction.

Figure 14B:
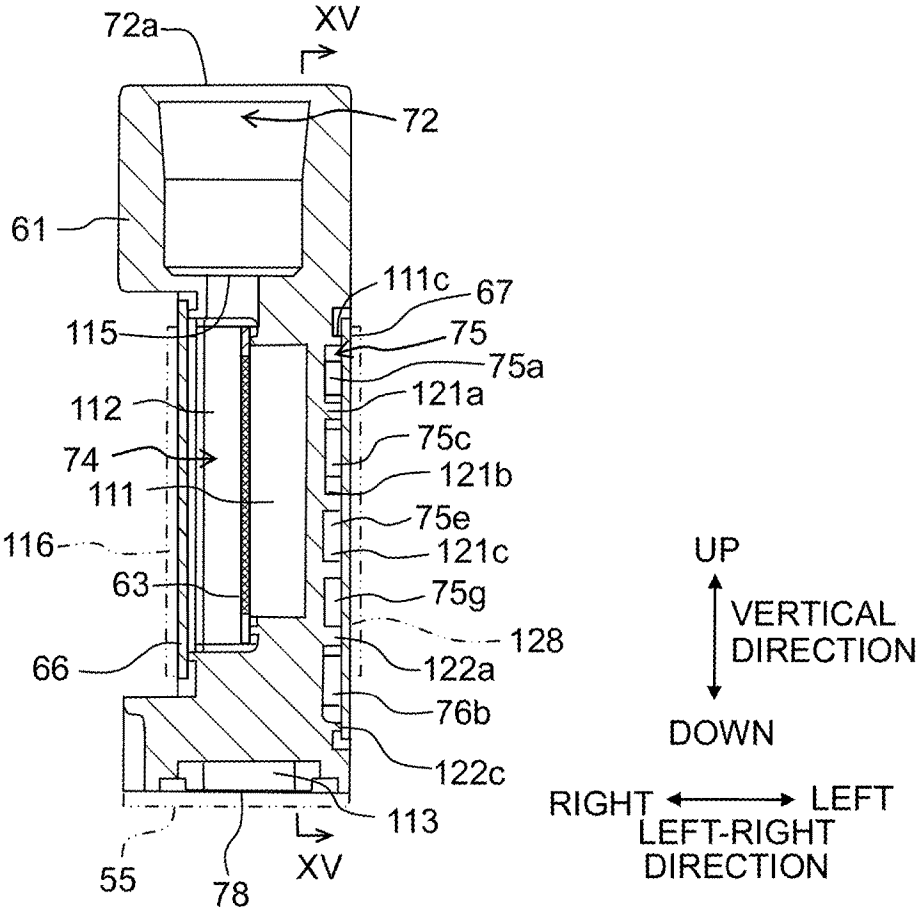
FIG. 14B is a cross-sectional view of FIG. 10 taken along a XIVB-XIVB line of FIG. 10, in the state that the metallic plate is attached.
Figure 14A:
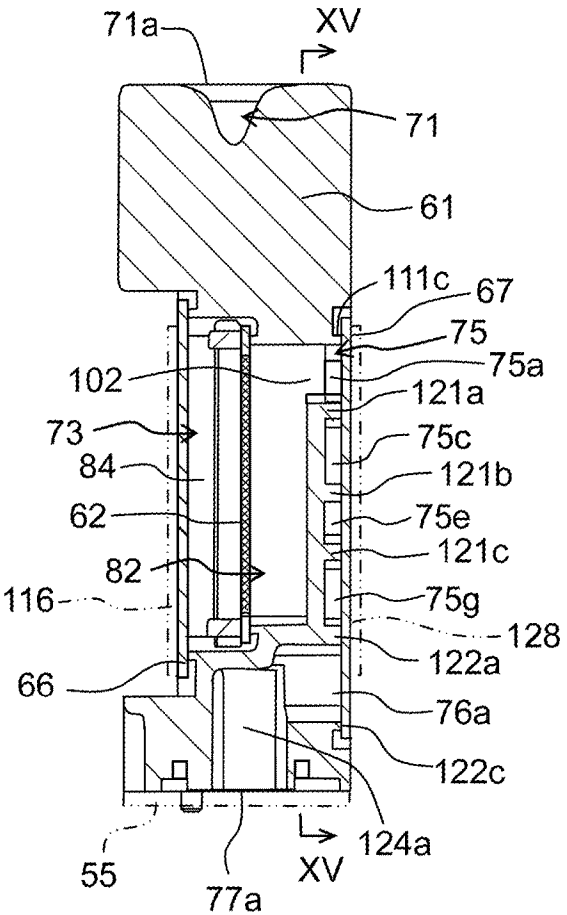
FIG. 14A is a cross-sectional view of FIG. 10 taken along a XIVA-XIVA line of FIG. 10, in the state that the metallic plate is attached.

Further, as depicted in FIG. 14A, the outflow liquid chamber 82 has a communicating hole 102 at an upper left portion of a rear wall thereof which faces the filter 63 in the left-right direction. The communicating hole 102 is configured to communicate the outflow liquid chamber 82 and the heating chamber 75 with each other.

The ink which has flowed from the inlet 71*a* into the case 27 flows from the inlet 86 into the first liquid chamber 83. The ink inside the first liquid chamber 83 flows to the second liquid chamber 84 via the gaps 98 and 99. Further, the ink in the first liquid chamber 83 and the second liquid chamber 84 passes through the filter 62 and then flows to the liquid outflow chamber 82. The ink inside the outflow liquid chamber 82 flows out of the outflow liquid chamber 82 and into the heating chamber 75 from the communicating hole 102.

The filter chamber 74 is located at a position below the outflow port 72 and on the rear side of (behind) the filter chamber 73, and is connected to the outflow port 72. The filter 63 is accommodated in the filter chamber 74. The filter 63 extends in the vertical direction, and has a filtering surface which is orthogonal to the left-right direction. Further, as depicted in FIG. 14B, in the filter chamber 74, a portion on the left side relative to the filer 63 is a liquid chamber 111, and another portion on the right side relative to the filter 63 is a liquid chamber 112. As depicted in FIG. 15, a channel 113 which extends along the vertical direction is formed in a portion, of the case 27, which is located at a position below the liquid chamber 111. In the channel 113, an upper end thereof is connected to the liquid chamber 111, and a lower end there of is connected to the outflow-connecting port 78. The outflow-connecting port 78 is overlapped in the vertical direction with the two outlets 52*b*1 and 52*c*1 of the head 21 and with the seal portion 56*b* of the sealer 55. With this, the two outlets 52*b*1 and 52*c*1 of the head 21 are communicated with the outflow-connecting port 78. Further, the sealer 55 makes contact with the upper surface of the head 21 (head holder 32) and with the lower surface of the case 27. With this, the ink is prevented from leaking out from a location between the two outlets 52*b*1 and 52*c*1 and the outflow-connecting port 78. Furthermore, as depicted in FIG. 14B, an outlet 115 is formed in the upper end portion of the liquid chamber 112; the outlet 115 is configured to allow the ink in the inside of the liquid chamber 112 to outflow therefrom. The outlet 115 is connected to the outflow port 72.

The ink, outflowed from the outlets 52*b*1 and 52*c*1 of the head 21, flows into the case 27 from the outflow-connecting port 78, and flows into the liquid chamber 111 via the channel 113. The ink inside the liquid chamber 111 passes through the filter 63 and then flows into the liquid chamber 112. The ink inside the liquid chamber 112 flows out of the liquid chamber 112 from the outlet 115. The ink outflowed from the outlet 115 of the liquid chamber 112 further flows out of the case 27 from the outlet 72*a* of the case 27 toward the ink tank T.

As depicted in FIGS. 9, 13A, 13B, 14A and 14B, the metallic plate 66 is a substantially rectangular plate formed of a metallic material, and is joined to a right end surface of the case body 61. With this, the right end of the filter chamber 73 (inflow liquid chamber 81) and the right end of the filer chamber 74 (liquid chamber 112) are defined by the metallic plate 66. Further, as depicted in FIGS. 13A and 13B, a right end surface of the first wall 65 is welded to the metallic plate 66. Furthermore, a heater 116 is arranged on an outer surface (right surface) of the metallic plate 66. The heater 116 is configured to heat the ink inside the filter chambers 73 and 74 by heating the metallic plate 66 and by transferring heat via the metallic plate 66.

Figure 11:
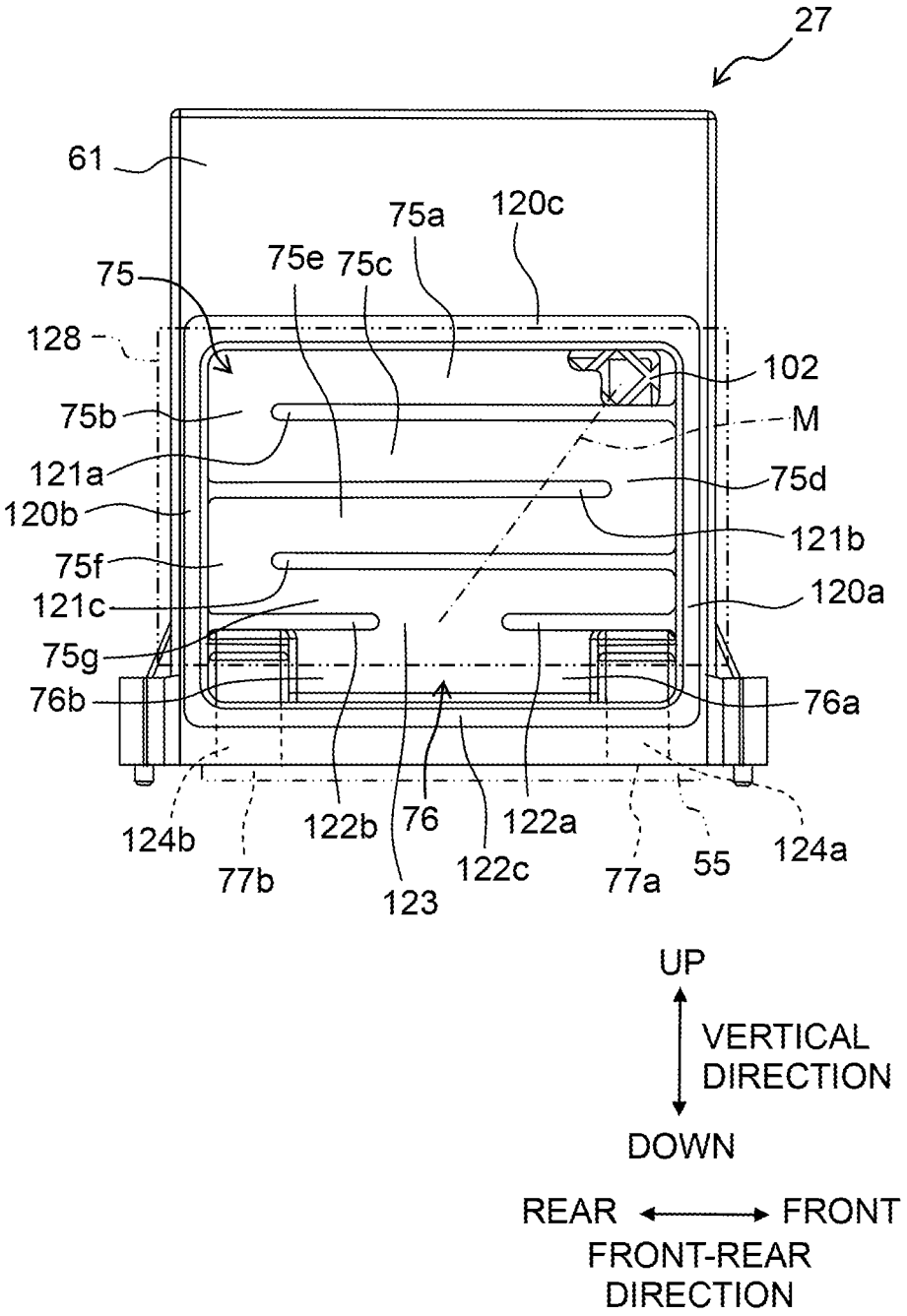
FIG. 11 is a view of the case as seen from the left side in the state that a metallic plate is removed from the case.
Figure 12A:
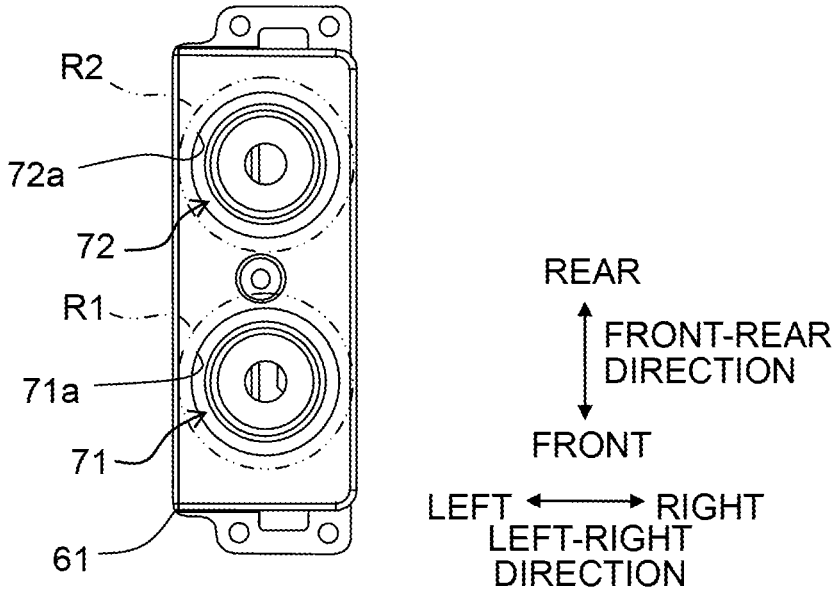
Figure 12B:
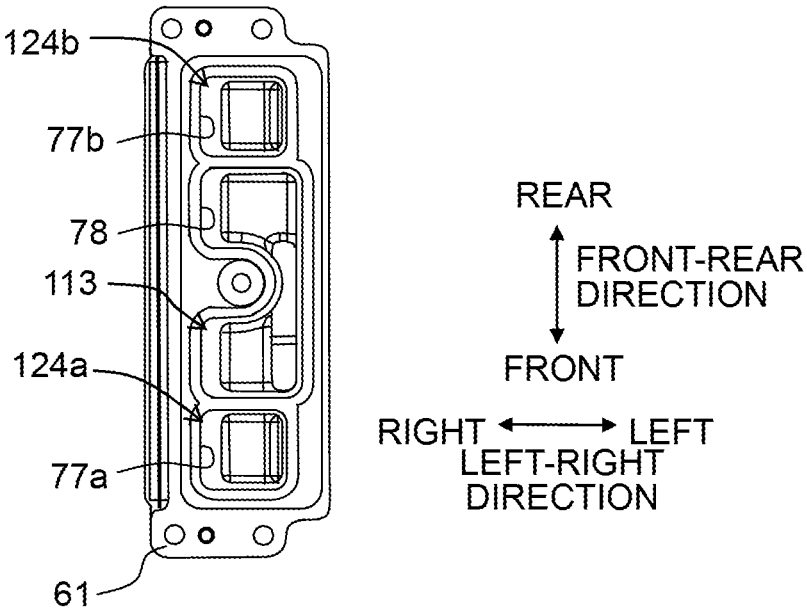
FIG. 12B is a view of the case as seen from the lower side.

As depicted in FIGS. 13A, 13B, 14A and 14B, the heating chamber 75 is located at a position on the left side relative to the filter chambers 73 and 74. The heating chamber 75 is a space having a substantially rectangular shape as seen from the left-right direction. As depicted in FIG. 11, the communicating hole 102 is located at an upper front end portion of the heating chamber 75. Further, a first partition 121*a* is positioned at a location, of the heating chamber 75, which is immediately below the communicating hole 102. The first partition 121*a* extends parallel to the front-rear direction, from a wall 120*a* on the front side of the heating chamber 75 toward a wall 120*b* on the rear side of the heating chamber 75. Furthermore, a forward end portion of the first partition 121*a* is separated away from the wall 120*b*. Namely, the first partition 121*a* and the wall 120*b* are apart from each other in the front-rear direction, and a space 75*b* is present between the first partition 121*a* and the wall 120*b*.

Further, in the heating chamber 75, a second partition 121*b* is positioned at a location below the first partition 121*a*. The second partition 121*b* extends parallel to the front-rear direction from the wall 120*b* toward the wall 120*a*. Furthermore, a forward end portion of the second partition 121*b* is separated away from the wall 120*a*. Namely, the second partition 121*a* and the wall 120*a* are apart from each other in the front-rear direction, and a space 75*d* is present between the second partition 121*b* and the wall 120*a*. Moreover, in the heating chamber 75, a third partition 121*c* is positioned at a location below the second partition 121*b*. The third partition 121*c* extends parallel to the front-rear direction from the wall 120*a* toward the wall 120*b*. Further, a forward end portion of the third partition 121*c* is separated away from the wall 120*b*. Namely, the third partition 121*c* and the wall 120*b* are apart from each other in the front-rear direction, and a space 75*f* is present between the third partition 121*c* and the wall 120*b*.

Further, a first rib 122*a* and a second rib 122*a* are arranged each at a position below the third partition 121*c*. The first rib 122*a* extends parallel to the front-rear direction from the wall 120*a* up to a position in the vicinity of a central portion in the front-rear direction of the heating chamber 75. The second rib 122*b* extends parallel to the front-rear direction from the wall 120*b* up to a position in the vicinity of the central portion in the front-rear direction of the heating chamber 75. Furthermore, the first rib 122*a* and the second rib 122*b* are separated from each other in the front-rear direction. Moreover, the first rib 122*a* and the second rib 122*b* have a same length in the front-rear direction. The first rib 122*a* and the second rib 122*b* define a lower end of the heating chamber 75. Further, a gap between the first rib 122*a* and the second rib 122*b* which are separated from each other defines a communicating hole 123 configured to communicate the heating chamber 75 and the connecting channel 76. By allowing the partitions 121*a* to 121*c* and the ribs 122*a* and 122*b* to be positioned as described above, each of the partitions 121*a* to 121*c* crosses a straight line M connecting the center of the communicating hole 102 in the front-rear direction with the center of the communicating hole 123 in the front-rear direction.

The ink inside the outflow liquid chamber 82 flows from the communicating hole 102 into the heating chamber 75. The ink flowed from the communicating hole 102 into the heating chamber 75 flows rearwardly in a space 75*a*. The space 75*a* is a space extending in the front-rear direction between a wall 120*c* on the upper side of the heating chamber 75 and the first partition 121*a*. Further, the ink flows into a space 75*c* via the space 75*b*, and flows frontwardly in the space 75*c*. The space 75*b* is a space defined between the forward end portion of the first partition 121*a* and the wall 120*b*. The space 75*c* is a space extending in the front-rear direction between the first partition 121*a* and the second partition 121*b*. Furthermore, the ink flows rearwardly in a space 75*e* via the space 75*d*. The space 75*d* is a space defined between the forward end portion of the second partition 121*b* and the wall 120*a*. The space 75*e* is a space extending in the front-rear direction between the second partition 121*b* and the third partition 121*c*. Moreover, the ink flows frontwardly in a space 75*g* via the space 75*f*, and reaches the communicating hole 123. The space 75*f* is a space defined between the forward end portion of the third partition 121*c* and the wall 120*b*. The space 75*g* is a space between the third partition 121*c* and the second rib 122*a*.

Further, a third rib 122*c* extending in the front-rear direction over the first rib 122*a* and the second rib 122*b* is located at a position below the first and second ribs 122*a* and 122*b*. The walls 120*a* and 120*b* of the heating chamber 75 extend to a location below the first and second ribs 122*a* and 122*b*, and both end portions in the front-rear direction of the third rib 122*c* are connected to the wall 120*a* and 120*b*, respectively.

The connecting channel 76 is a channel which extends in the front-rear direction, of which upper end is defined by the first and second ribs 122*a* and 122*b*, and of which lower end is defined by the third rib 122*c*. The connecting channel 76 has a first channel 76*a* and a second channel 76*b*. The first channel 76*a* is a portion, of the connecting channel 76, which is located on the front side relative to the communicating hole 123, of which upper and lower portions are defined respectively by the first rib 122*a* and the third rib 122*c*, and which extends in the front-rear direction. The second channel 76*b* is a portion, of the connecting channel 76, which is located on the rear side relative to the communicating hole 123, of which upper and lower portions are defined respectively by the second rib 122*b* and the third rib 122*c*, and which extends in the front-rear direction. The ink flowed into the connecting channel 76 from the communicating hole 123 is divided to flow in the first channel 76*a* and to flow in the second channel 76*b*.

Here, as described above, the first rib 122*a* and the second rib 122*b* have the same length in the front-rear direction, and the ribs 122*a*, 122*b* and 122*c* are parallel to one another. Therefore, the first channel 76*a* and the second channel 76*b* have a same length in the front-rear direction (channel length) and a same cross-sectional area of a cross section orthogonal to the front-rear direction (direction of the channel length). Further, the first channel 76*a* and the second channel 76*b* have a same inertance. The term "inertance" is a physical quantity indicating a degree of easiness of flowing of a liquid, and is expressed as $\rho(L/S)$, wherein $\rho$ represents the fluid density, L represents the length of a conduit channel via which a fluid flows, and S represents a cross-sectional area of a cross section orthogonal to the length direction of the channel via which the fluid flows. Further, this indicates that as the inertance is smaller, the fluid flows more easily. In the present embodiment, the configuration wherein the first channel 76*a* and the second channel 76*b* have the same inertance is not limited to or restricted by such a configuration that the first channel 76*a* and the second channel 76*b* have a strictly same inertance; it is allowable, for example, that the above configuration also encompasses such a configuration wherein although the first channel 76*a* and the second channel 76*b* have a same inertance in design, there is a difference to some extent in the inertance of the first channel 76*a* and the inertance of the second channel 76*b* due to any effect caused by a manufacturing error, etc.

Further, a channel 124*a* extending in the vertical direction is formed in the case 27 at a portion located at a position below a front end portion of the first channel 76*a*. An upper end of the channel 124*a* is connected to the first channel 76*a*, and a lower end of the channel 124*a* is the inflow-connecting port 77*a* which is open in the lower surface of the case 27. Furthermore, a channel 124*b* extending in the vertical direction is formed in the case 27 at a portion located at a position below a rear end portion of the second channel 76*b*. An upper end of the channel 124*b* is connected to the second channel 76*b*, and a lower end of the channel 124*b* is the inflow-connecting port 77*b* which is open in the lower surface of the case 27.

The inflow-connecting port 77*a* is overlapped, in the vertical direction, with the inlet 52*a*1 (see FIG. 7) of the head 21 and with the seal portion 56*a* (see FIG. 7) of the sealing material 55. With this, the inlet 52*a*1 of the head 21 and the inflow-connecting port 77*a* are communicated with each other. The inflow-connecting port 77*b* is overlapped, in the vertical direction, with the inlet 52*d*1 (see FIG. 7) of the head 21 and with the seal portion 56*d* (see FIG. 7) of the sealing material 55. With this, the inlet 52*d*1 of the head 21 and the inflow-connecting port 77*b* are communicated with each other. Further, the sealing material 55 makes contact with the upper surface of the head 21 (head holder 32) and the lower surface of the case 27. With this, the ink is prevented from leaking out from locations between the inlets 52*a*1, 52*d*1 and the inflow-connecting ports 77*a*, 77*b*, respectively.

The ink flowing through the first channel 76*a* further flows downwardly through the channel 124*a*, flows out of the channel 124*a* from the inflow-connecting port 77*a*, and flows into the head 21 from the inlet 52*a*1. Further, the ink flowing through the second channel 76*b* further flows downwardly through the second channel 124*b*, flows out of the channel 124*b* from the inflow-connecting port 77*b*, and flows into the head 21 from the inlet 52*d*1.

The metallic plate 67 is a substantially rectangular plate formed of a metallic material; as depicted in FIGS. 13A, 13B, 14A and 14B, the metallic plate 67 is joined to a left end surface of the case body 61. With this, the left end of the heating chamber 75 and the left end of the connecting channel 76 are defined by the metallic plate 67. Further, a heater 128 is arranged on an outer surface (left surface) of the metallic plate 67. The heater 128 faces the heating chamber 75 and a substantially upper half portion of the connecting channel 76 in the left-right direction. The heater 128 is configured to heat the ink inside the heating chamber 75 and the connecting channel 76 by heating the metallic plate 67 and transferring heat via the metallic plate 67.

Figure 16A:
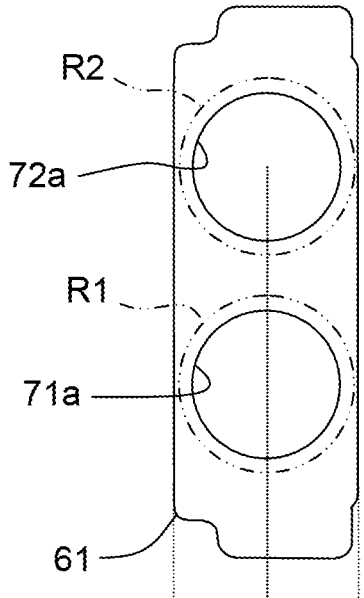
FIG. 16A is a view depicting the positional relationship between an inlet and an outlet on the upper surface of the case with respect to the outer shape of the case, as seen from the upper side.
Figure 16B:
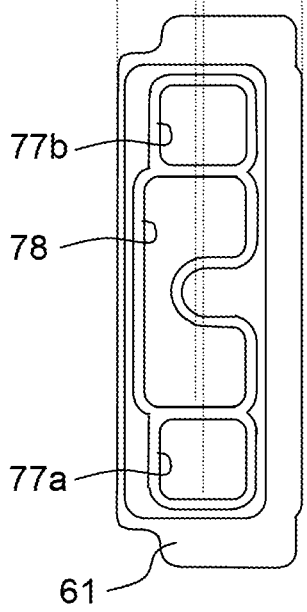
FIG. 16B is a view depicting the positional relationship between an inflow-connecting port and an outflow-connecting port on the lower surface of the case with respect to the outer shape of the case, as seen from the lower side.
Figure 16B:
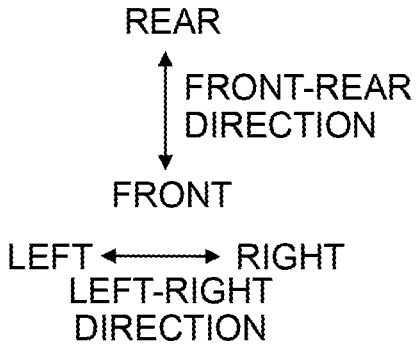

Here, an explanation will be given about the positional relationship among the inlets 71*a*, 72*a*, the inflow-connecting ports 77*a*, 77*b* and the outflow-connecting ports 78*a* in the case 27. As depicted in FIGS. 16A and 16B, in the left-right direction, the center of the inlet 71*a* and the center of the outlet 72*a* are located on the right side, namely located closer to the nozzles 10, relative to the centers of the inflow-connecting ports 77*a*, 77*b* and the center of the outflow-connecting port 78.

<Cooler>

Figure 5:
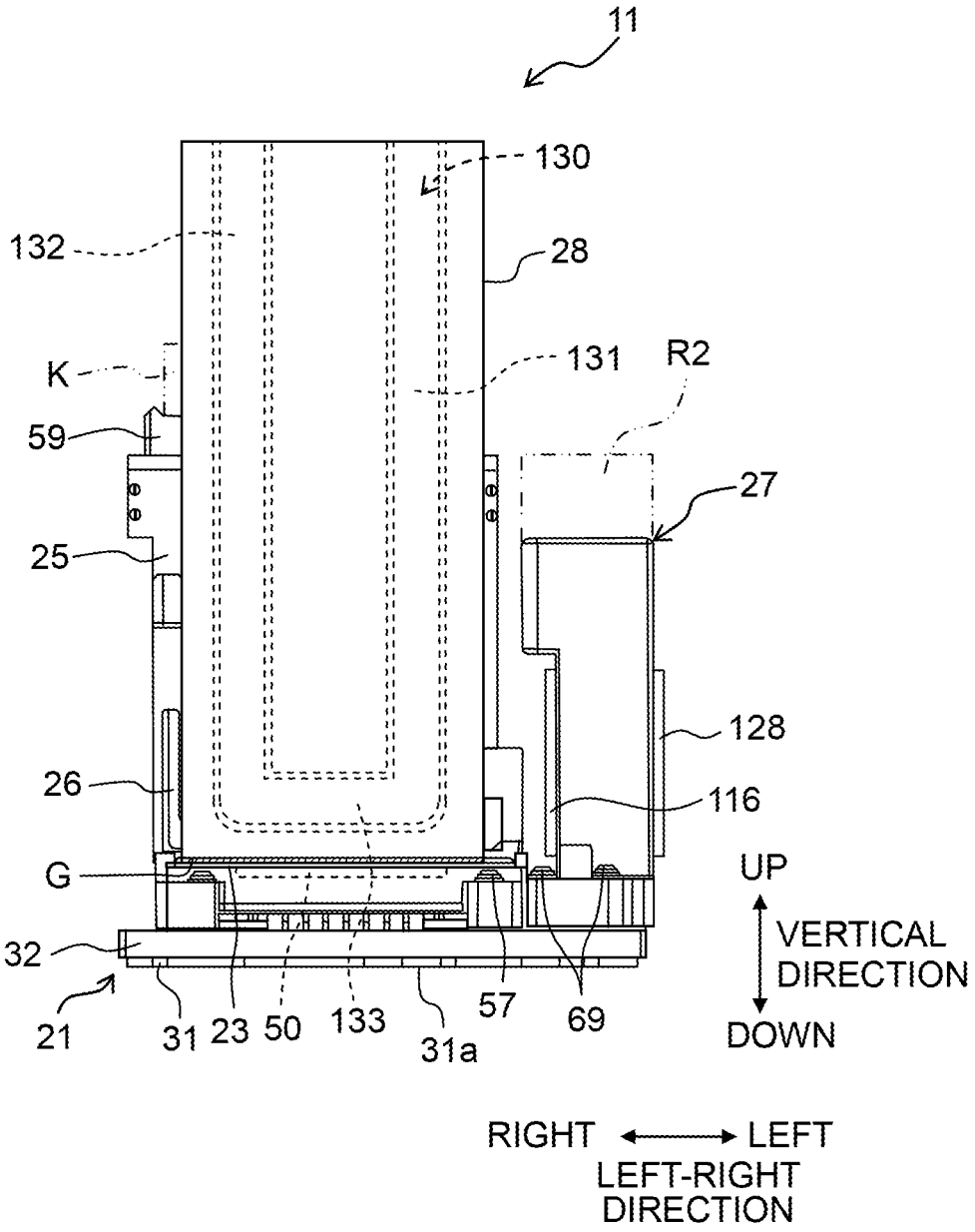
FIG. 5 is a view of the head module as seen from the rear side.

As depicted in FIGS. 3 to 6, the cooler 28 is configured to have a substantially rectangular parallelepiped shape which is elongated in the vertical direction, is arranged on the upper surface of the heat spreader 23, and is arrange side by side to the case 27 in the left-right direction. Further, as depicted in FIG. 5, a heat radiation grease G is located between the cooler 28 and the upper surface of the heat spreader 23. Namely, the cooler 28 and the heat spreader 23 are thermally connected to each other via the heat radiation grease G. Furthermore, the heat radiation grease G makes contact with the heat spreader 23 and the cooler 28. Note that in FIG. 5, the thickness of the heat radiation grease G is illustrated to be large, and the heat radiation grease G is indicated with a hatching so that the position of the heat radiation grease G can be easily understood.

The cooler 28 has a cooling channel 130 which is formed in the inside of the cooler 28 and via which a coolant (cooling liquid) flows. As depicted in FIG. 6A, the cooling channel 130 is located at a position which is same in the front-rear direction as positions of the center of the heater 116 and the center of the heater 128. As depicted in FIGS. 4, 5, 6A and 6B, the cooling channel 130 has a first portion 131, a second portion 132 and a third portion 133. The first portion 131 is located at a position on the left side of the cooler 28 and extends in the vertical direction. The second portion 132 is a downstream portion, of the cooler 28, which is on the downstream side in a flow of the coolant with respect to the first portion 131, is located on a portion on the right side of the cooler 28, and extends in the vertical direction. Namely, in the cooler 28, the first portion 131 is located to be closer in the left-right direction to the heaters 116 and 128 than the second portion 132, as depicted in FIGS. 5 and 6A. The third portion 133 extends in the left-right direction and connects a lower end portion of the first portion 131 and a lower end portion of the second portion 132, as depicted in FIGS. 5 and 6A. Further, in the cooling channel 130, the coolant flows in the first portion 131 from the upper side toward the lower side, flows in the third portion 133 from the left side toward the right side, and flows in the second portion 132 from the lower side toward the upper side. Namely, in the cooling channel 130, the coolant flows in an order of the first portion 131, the third portion 133 and the second portion 132.

The heat transferred from the driver ICs 50 to the heat spreader 23 is transferred from the heat spreader 23 to the cooler 28, and is released to the outside by the coolant flowing in the cooling channel 130. In this situation, the heat spreader 23 equalizes the heat transferred from the driver ICs 50.

<Purge Device>

Figure 17:
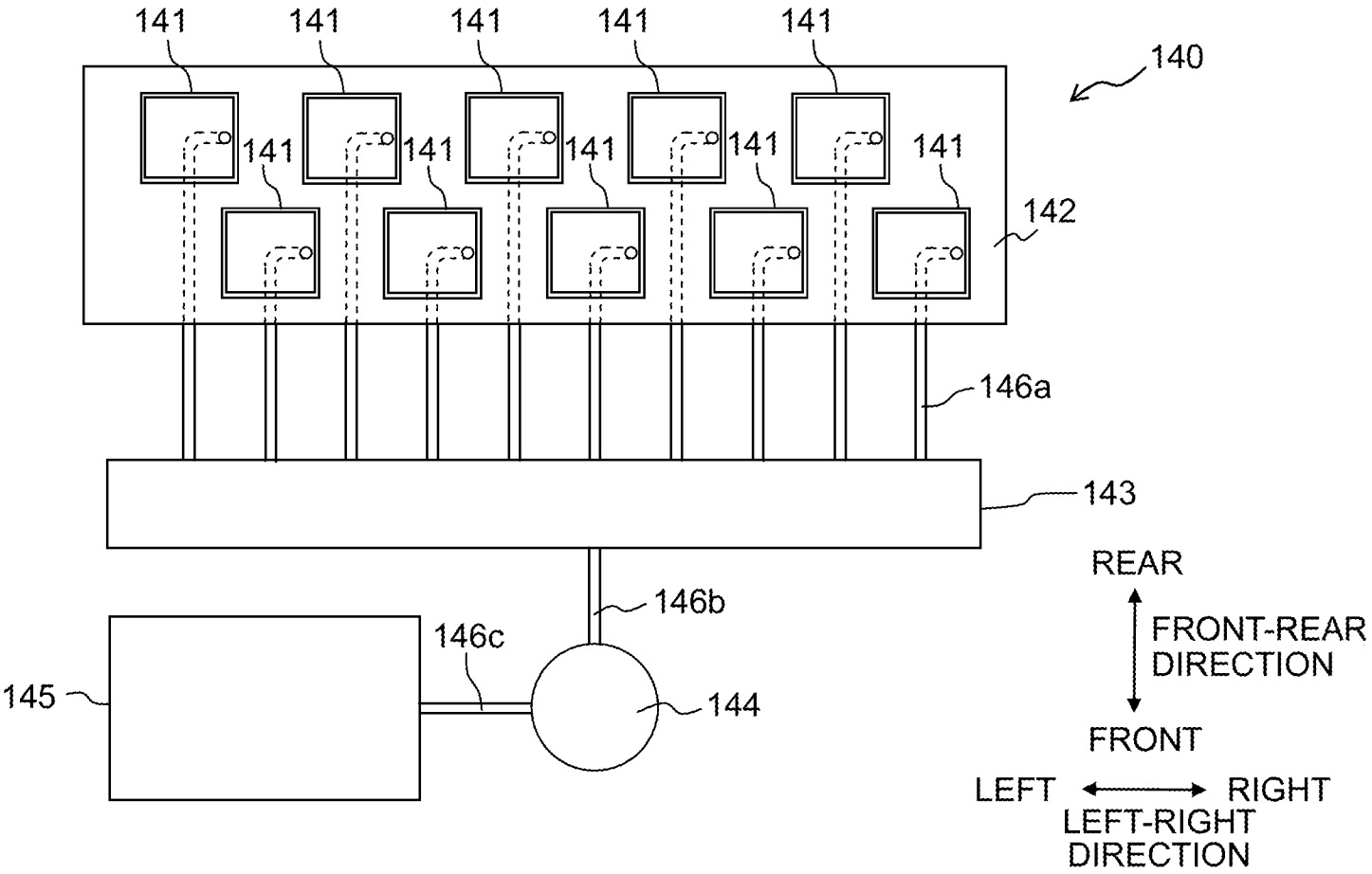
FIG. 17 is a view schematically depicting the configuration of a purge device.

Further, the printing apparatus 1 is provided with a purge device 140 depicted in FIG. 17, in addition to the configurations as described above. The purge device 140 is configured to perform a so-called suction purge for causing the ink inside the head module 11 to be jetted or discharged from the plurality of nozzles 10. The purge device 140 is provided with ten pieces of cap 141, a cap holder 142, a switching device 143, a pump 144 and a waste liquid tank 145.

The number of the cap 141 is same as the number of the head module 11. Namely, one piece of the cap 141 is present corresponding to one piece of the head module 11. The positional relationship among the ten caps 141 with one another is similar to the positional relationship among the ten head modules 11 with one another. Namely, in correspondence to that the ten head modules 11 are positioned in the staggered manner, the ten caps 141 are positioned in the staggered manner. The cap holder 142 is configured to hold the ten caps 141 such that the ten caps 141 have the above-described positional relationship. Further, the cap holder 142 is configured to be movable in the vertical direction and the horizontal direction (for example, the front-rear direction or the left-right direction) by a non-illustrated moving device. The moving device moves the cap holder 142 between a retracted position and a capping position. In a case that the suction purge is not performed, for example, as during the printing, etc., the cap holder 142 is located at the retracted position at which the cap holder 142 does not overlap with the plurality of head modules 11 in the vertical direction. On the other hand, in a case that the suction purge is performed, the cap holder 142 is located at the capping position at which each of the plurality of caps 141 covers the plurality of nozzles 10 of one of the plurality of head modules 11 corresponding thereto.

The ten caps 141 are connected to the switching device 143 via ten tubes 146*a*, respectively. Further, the switching device 143 is connected to the pump 144 via a tube 146*b*. Further, the switching device 143 selectively connects, to the pump 144, any one of the ten caps 141. The pump 141 is, for example, a tube pump, etc., and is connected to the waste liquid tank 145 via a tube 146*c*.

In order to perform the suction purge by the purge device 140, the cap holder 142 is moved to the capping position by the moving device. After locating the cap holder 142 at the capping position, then, the switching device 143 connects any one cap 141 among the ten caps 141 with the pump 144. Further, in this state, the pump 144 is driven. Then, any viscous ink inside the head module 11, etc., is jetted or discharged from the plurality of nozzles 10 covered by the one cap 141 connected to the pump 144. Furthermore, by switching a cap 141, among the ten caps 141, which is connected to the pump 144 in order by the switching device 143 and by driving the pump 144, the viscous ink, etc., is made to be jetted from each of the head modules 11 in order. Note that the jetted ink is stored in the waste liquid tank 145.

Note that when the suction purge is performed, the suction by the pump 141 causes the ink inside the liquid chamber 112 to flow into the liquid chamber 111 via the filter 63. Further, the ink flowed into the liquid chamber 111 flows into the inside of the head 21 via the outflow-connecting port 78 and the outlets 52*b*1 and 52*c*1. Since the filter 63 is located in the inside of the filter chamber 74, it is also possible to prevent the foreign matter or substance, etc., in the ink from flowing into the head 21 even when such a flow of the ink is generated.

Here, unlike the embodiment, when the case 27 includes the respective inflow ports 71 for the two inflow-connecting ports 77*a*, 77*b*, a channel connecting the ink tank T and the inflow port 71 corresponding to the inflow-connecting port 77*a* may be different in environment, such as ambient temperature, from a channel connecting the ink tank T and the inflow port 71 corresponding to the inflow-connecting port 77*b*. In that case, the viscosity etc., of ink flowing through one of the two inflow ports 71 may be different from those of ink flowing through the other of the two inflow ports 71, and thus the viscosity etc., of ink flowing into the head 21 from the inlet 52*a*1 may be different from those of ink flowing into the head 21 from the inlet 52*d*1. As a result, ink jetting properties may vary between the nozzles 10.

In order to solve the above problem, in the embodiment, the case 27 includes the inflow port 71 (inlet 71*a*) common to the two inflow-connecting ports 77*a*, 77*b* to cause the ink coming from the inflow port 71 to flow out of the two inflow-connecting ports 77*a*, 77*b*. This may uniformize the viscosity etc., of ink flowing into the head 21 from the inlet 52*a*1 and the viscosity etc., of ink flowing into the head 21 from the inlet 52*d*1.

In the embodiment, the ink may be jetted from two or more nozzles 10 of the head 21. In that case, the ink jetting velocity from each nozzle 10 may be faster than the ink supply velocity from the inlets 52*a*1, 52*d*1. This increases negative pressure in the pressure chamber 35. The increase in negative pressure leads to a situation in which the ink supplied from the inlets 52*a*1, 52*d*1 to the head 21 is not enough as the ink supply amount, causing the ink to flow into the head 21 also from the outlets 52*b*1, 52*c*1. That is, the ink flows backward in the outlets 52*b*1, 52*c*1. Here, unlike the embodiment, when a channel connecting the ink tank T and the inlets 52*a*1, 52*d*1 is different in environment, such as ambient temperature, from a channel connecting the ink tank T and the outlets 52*b*1, 52*c*1, the ink flowing into the head 21 from the inlets 51*a*1 and 51*d*1 may be different, for example, in viscosity from the ink flowing into the head 21 from the outlets 51*b*1 and 51*c*1. As a result, ink jetting properties may vary between the nozzles 10.

In order to solve the above problem, in the embodiment, the case 27 includes the inflow-connecting ports 77*a*, 77*b* connected to the inlets 52*a*1, 52*d*1 of the head 21 and the inflow port 71 (inlet 71*a*) communicating with the inflow-connecting ports 77*a*, 77*b*. Further, the case 27 includes the outflow-connecting port 78 connected to the outlets 52*b*1, 52*c*1 of the head 21 and the outflow port 72 (outlet 72*a*) communicating with the outflow-connecting port 78. In that configuration, the ink flowing into the head 21 from the inlets 52*a*1, 52*d*1 and the ink flowing into the head 21 from the outlets 52*b*1, 52*c*1 both flow into the head 21 after flowing through the case 27. This may uniformize the viscosity etc., of ink flowing into the head 21 from the inlets 52*a*1, 52*d*1 and the viscosity etc., of ink flowing into the head 21 from the outlets 52*b*1, 52*c*1.

Due to the ink circulation between the head module 11 and the ink tank T, the head module 11 has an ink current such that the ink in the case 27 coming from the inflow-connecting ports 77*a*, 77*b* flows into the head 21 through the inlets 52*a*1, 52*d*1. Further, the head module 11 has an ink current such that the ink in the head 21 coming from the outlets 52*b*1, 52*c*1 flows into the case 27 through the outflow-connecting port 78. Thus, when the ink flows into the head 21 from the inlets 52*a*1, 52*d*1, the ink having the above ink current flows out of the inflow-connecting ports 77*a*, 77*b*. On the other hand, as described above, when the ink flows into the head 21 from the outlets 52*b*1, 52*c*1, the ink flowing against the above ink current flows out of the outflow-connecting port 78. Thus, the ink is less likely to flow out of the outflow-connecting port 78 than the inflow-connecting ports 77*a*, 77*b*. In order to solve that problem, in the embodiment, the opening area of the outflow-connecting port 78 is larger than those of the inflow-connecting ports 77*a*, 77*b*. This allows the ink to flow out of the outflow-connecting port 78 as easily as possible.

In the embodiment, the ink heated in the heating chamber 75 flows through the first channel 76*a* and the second channel 76*b* branched from the connecting channel 76 to reach the inflow-connecting ports 77*a*, 77*b*. This may certainly uniformize the viscosity etc., of ink flowing into the head 21 from the inlet 52*a*1 and the viscosity etc., of ink flowing into the head 21 from the inlet 52*d*1.

In the embodiment, the heater 128 heating the ink in the heating chamber 75 extends below the heating chamber 75 to a position facing the connecting channel 76 in the left-right direction. In that configuration, the ink in the connecting channel 76 is also heated, thereby making it possible to certainly uniformize the viscosity etc., of ink flowing into the head 21 from the inlet 52*a*1 and the viscosity etc., of ink flowing into the head 21 from the inlet 52*d*1.

In the embodiment, the first channel 76*a* and the second channel 76*b* configuring the connecting channel 76 have the same inertance. Specifically, the first channel 76*a* and the second channel 76*b* have the same length in the front-rear direction (channel length) and the same cross-sectional area of the cross section orthogonal to the front-rear direction (channel length direction). Namely, the first channel 76*a* and the second channel 76*b* have the same degree of easiness of flowing of the ink. This may uniformize the viscosity etc., of ink flowing out of the inflow-connecting port 77*a* and then flowing into the head 21 from the inlet 52*a*1 and the viscosity etc., of ink flowing out of the inflow-connecting port 77*b* and then flowing into the head 21 from the inlet 52*d*1.

In the embodiment, the case 27 includes the ribs 122*a* to 122*c*. The first rib 122*a* and the second rib 122*b* extend parallel to the front-rear direction and are separated from each other in the front-rear direction. The first rib 122*a* and the second rib 122*b* have the same length in the front-rear direction. The third rib 122*c*, which is arranged below the first and second ribs 122*a* and 122*b*, extends parallel to the front-rear direction over the first rib 122*a* and the second rib 122*b*. The first channel 76*a* is the channel of which upper and lower portions are defined by the first rib 122*a* and the third rib 122*c*, and the second channel 76*b* is the channel of which upper and lower portions are defined by the second rib 122*b* and the third rib 122*c*. In that configuration, the first channel 76*a* and the second channel 76*b* may have the same length in the front-rear direction and the same cross-sectional area of the cross section orthogonal to the front-rear direction, thus causing the first channel 76*a* and the second channel 76*b* to have the same inertance.

In the embodiment, the heating chamber 75 is partitioned by the partitions 121*a* to 121*c* intersecting with the straight line M that connects the communicating hole 102, which allows the heating chamber 75 to communicate with the outflow liquid chamber 82, and the communicating hole 123, which allows the heating chamber 75 to communicate with the connecting channel 76. In that configuration, the ink flowing into the heating chamber 75 from the communicating hole 102 flows through the spaces 75*a* to 75*g*, of the heating chamber 75, which are partitioned by the partitions 121*a* to 121*c* in that order to reach the communicating hole 123.

Here, the embodiment is compared with a case in which the heating chamber 75 is not partitioned by the partitions 121*a* to 121*c*. When comparing the two cases, the embodiment may have a longer ink-flow distance when the ink in the heating chamber 75 flows from the communicating hole 102 to the communicating hole 123. This allows the ink in the heating chamber 75 to be heated efficiently.

In the embodiment, the first partition 121*a* extends from the wall 120*a* on the front side of the heating chamber 75 toward the rear wall 120*b*, and the communicating hole 102 is positioned at the front upper part of the heating chamber 75. This lengthens the ink-flow distance when the ink flows through the space 75*a* from the communicating hole 102 to the rear side, thus making it possible to heat the ink in the heating chamber 75 more efficiently.

In the embodiment, the left end of the heating chamber 75 and the left end of the connecting channel 76 are defined by the metallic plate 67, and the heater 128 is fixed to the outer surface of the metallic plate 67. In that configuration, the heat of the heater 128 may be efficiently transmitted to the ink in the heating chamber 75 and the connecting channel 76 via the metallic plate 67.

In the embodiment, the heater 116 is fixed to the outer surface of the metallic plate 66 defining the right end of the filter chamber 74 to heat the ink in the filter chamber 74. In that configuration, when the ink flows into the head 21 from the outlets 52*b*1, 52*c*1 as described above, the ink heated in the filter chamber 74 flows into the head 21 from the outlets 52*b*1, 52*c*1. Thus, the ink flowing into the head 21 from the inlets 52*a*1, 52*d*1 and the ink flowing into the head 21 from the outlets 52*b*1, 52*c*1 both flow into the head 21 after being heated in the case 27. This may certainly uniformize the viscosity etc., of ink flowing into the head 21 from the inlets 52*a*1, 52*d*1 and the viscosity etc., of ink flowing into the head 21 from the outlets 52*b*1, 52*c*1.

In the embodiment, the case 27 includes the filter chambers 73, 74. Thus, foreign matter and the like in the ink are caught by the filter 62 of the filter chamber 73 before the ink flows into the head 21 from the inlets 52*a*1, 52*d*1. Further, foreign matter and the like in the ink are caught by the filter 63 of the filter chamber 74 before the ink flows into the head 21 through the outlets 52*b*1, 52*c*1. Accordingly, the foreign matter and the like in the ink are prevented from flowing into the head 21.

In the embodiment, the inlet 86 of the filter chamber 73 is provided at the upper end of the first liquid chamber 83, and the communicating hole 102 is positioned at the upper left end of the outflow liquid chamber 82. Thus, the ink flowing through the filter chamber 73 from the inlet 86 toward the communicating hole 102 tries to flow through an upper part of the filter chamber 73. On the other hand, the ink in the filter chamber 73 tries to move downward due to the influence of gravity. Thus, the ink in the filter chamber 73 is allowed to flow uniformly through an entire area of the filter 62.

In the embodiment, the inflow-connecting ports 77*a*, 77*b* and the outflow-connecting port 78 are positioned at the lower end of the case 27 and the sealer 55 is connected to the lower surface of the case 27. Meanwhile, the inlet 71*a* of the inflow port 71 and the outlet 72*a* of the outflow port 72 are positioned on the upper surface of the case 27 and arranged in the front-rear direction. This configuration may downsize the case 27 in the front-rear direction as compared with a case in which the two inflow-connecting ports 77*a*, 77*b* have the respective inlets 71*a*.

In the embodiment, the connectors Ra and R2 are connected to the inflow port 71 and the outflow port 72 respectively. The connector R1 protrudes outward beyond the inflow port 71 when seen in a planer view. The connector R2 protrudes outward beyond the outflow port 72 when seen in a planer view. In that configuration, depending on the sizes of the connectors R1 and R2, the connectors R1 and R2 may protrude beyond the case 27 in the left-right direction. The connectors R1 and R2 protrude further leftward beyond the case 27, as the centers of the inlet 71*a* and the outlet 72*a* are closer to the left side. When the connectors R1 and R2 protrude leftward greatly beyond the case 27, the accommodation section 12*a* needs a space, in which the connectors R1 and R2 are provided, on the left side of the space accommodating the head module 11. This lengthens the accommodating section 12*a* in the left-right direction, resulting in the increase in size of the line head 4 in the left-right direction.

In order to solve the above problem, in the embodiment, in the left-right direction, the centers of the inlet 71*a* and the outlet 72*a* are positioned close to the nozzles 10, that is, on the right side of the centers of the inflow-connecting ports 77*a*, 77*b* and the center of the outflow-connecting port 78. This configuration may prevent the connectors R1 and R2 from protruding leftward beyond the case 27. Or, even when the connectors R1 and R2 protrude leftward beyond the case 27, the protruding amount may be reduced as much as possible.

Even when the connectors R1 and R2 protrude rightward beyond the case 27, parts of the connectors R1 and R2 protruding beyond the case 27 overlap in the vertical direction with a right part (a part formed with the nozzles 10) of the head 21 relative to the case 27. Thus, in that case, there is no need to lengthen the accommodating section 12 in the left-right direction.

The following explanation will be made on modified embodiments in which various modifications are added to the embodiment.

In the above embodiment, in the left-right direction, the centers of the inlet 71 and the outlet 72*a* are positioned on the right side of the centers of the inflow-connecting ports 77*a*, 77*b* and the center of the outflow-connecting port 78. The present teaching, however, is not limited thereto. In the left-right direction, the centers of the inlet 71*a* and the outlet 72*a* may be positioned at the same position as the centers of the inflow-connecting ports 77*a*, 77*b*, at the same position as the center of the outflow-connecting port 78, at a position between the centers of the inflow-connecting ports 77*a*, 77*b* and the center of the outflow-connecting port 78, or a position at the left side of the center of the outflow-connecting port 78.

In the above embodiment, the inflow-connecting ports 77*a*, 77*b* and the outflow-connecting port 78 are provided on the lower surface of the case 27, the sealer 55 is connected to the lower surface of the case 27, and the inlet 71*a* and the outlet 72*a* are positioned on the upper surface of the case 27 and arranged in the front-rear direction. The present teaching, however, is not limited thereto. The inlet 71*a* and the outlet 72*a* may be arranged in a direction different from the front-rear direction, such as the left-right direction. Or, at least one of the inlet 71*a* and the outlet 72*a* may be positioned at a part of the case 27 different from the upper surface.

In the above embodiment, the inlet 86 through which the ink flows into the filter chamber 73 is positioned at the upper end of the inflow liquid chamber 81 (first liquid chamber 83) that is upstream of the filter 62. Further, the communicating hole 102 through which the ink flows out of the filter chamber 73 is positioned at the front upper end of the outflow liquid chamber 82 that is downstream of the filter 62. The present teaching, however, is not limited thereto. The inlet 86 may be positioned at a center part, a lower part, or the like of the inflow liquid chamber 81 in the vertical direction. The communicating hole 102 may be positioned at the center part, the lower part, or the like of the inflow liquid chamber 81 in the vertical direction. When the position of the communicating hole 102 is changed, the position of the filter chamber exit through which the ink flows out of the filter chamber 73 and the position of the heating chamber entrance through which the ink flows into the heating chamber 75 are changed. The present teaching, however, is not limited thereto. The filter chamber exit and the heating chamber entrance may be formed at mutually different positions in the vertical direction or the front-rear direction. For example, the heating chamber entrance may be formed at the same position as the communicating hole 102 of the above embodiment, and the filter chamber exit and the communicating hole 102 of the above embodiment may be formed at different positions in the vertical direction or the front-rear direction. In that configuration, the case 27 needs to have a channel allowing the filter chamber exit to communicate with the heating chamber entrance.

In the above embodiment, the left end of the heating chamber 75 and the left end of the connecting channel 76 are defined by the metallic plate 67 and the heater 128 is fixed to the outer surface of the metallic plate 67. The present teaching, however, is not limited thereto. The left end of the heating chamber 75 and the left end of the connecting channel 76 may be defined by a member other than the metal material, and the heater 128 may be fixed to any wall of the heating chamber 75 and the connecting channel 76.

From the same viewpoint, the right end of the filter chamber 73 and the right end of the filter chamber 74 may be defined by a member other than the metal material, and the heater 116 may be fixed to any wall of the filter chambers 73, 74.

In the above embodiment, the case 27 includes the heater 116 heating the ink in the filter chambers 73, 74. The present teaching, however, is not limited thereto. The case 27 may include no heater heating the ink in the filter chambers 73, 74. A single heater may be adhered to the metallic plates 66, 67 in place of the two heaters 116, 128. In that configuration, a part of the single heater adhered to the metallic plate 66 corresponds to the heater 116 and a part adhered to the metallic plate 67 corresponds to the heater 128.

The case 27 may not include the filter chamber 74. The ink is likely to flow into the head 21 from the outlets 52*b*1, 52*c*1 during suction purge, in a case in which the ink jetting amount from the head 21 is large, and the like. Except for the suction purge and the case in which the ink jetting amount from the head 21 is large, no ink in the head 21 flows out of the outlets 52*b*1, 52*c*1 and no ink flows into the head 21 from the outlets 52*b*1, 52*c*1. Thus, the ink amount flowing into the head 21 from the outlets 52*b*1, 52*c*1 is smaller than the ink amount flowing into the head 21 from the inlets 52*a*1, 52*d*1. Namely, as compared to a case in which no filter chamber 73 is provided, foreign matter and the like in the ink are less likely to flow into the head 21 even without the filter chamber 74. Further, for example, when the ink at a position between the case 27 and the ink tank T (i.e., a position upstream of the case 27) contains little foreign matter and the like, the case 27 may not include the filter chamber 73.

In the above embodiment, the first partition 121*a* extends from the wall 120*a* on the front side of the heating chamber 75 toward the rear wall 121*b*, and the communicating hole 102 through which the ink flows into the heating chamber 75 is positioned at the front upper end of the heating chamber 75. The present teaching, however, is not limited thereto. The communicating hole 102 may be positioned on the rear side of that of the above embodiment. In that configuration, the communicating hole 102 is preferably closer to a position in the vicinity of the wall 120*a* than to the wall 120*b* in view of lengthening the ink-flow distance when the ink flows through the space 75*a* from the communicating hole 102 to the rear side. The communicating hole 102, however, may be closer to a position in the vicinity of the wall 102*b* than to the wall 120*a*.

In the above embodiment, the partitions 121*a* to 121*c* partitioning the heating chamber 75 are positioned in the heating chamber 75. The present teaching, however, is not limited thereto. If the heater 128 may heat the ink efficiently (the heating efficiency of the heater is good or ink flow velocity is almost constant), it is not indispensable to provide all the three partitions 121*a* to 121*c* in the heating chamber 75. For example, the third partition 121*c* may not be provided. Further, the second partition 121*b* may not be provided. Furthermore, the first partition 121*a* may not be provided.

In the above embodiment, the first channel 76*a* extends in the front-rear direction, of which upper and lower portions are defined by the first rib 122*a* and the third rib 122*c* parallel to the first rib 122*a*. The second channel 76*b* extends in the front-rear direction, of which upper and lower portions are defined by the third rib 122*c* and the second rib 122*b* parallel to the first rib 122*a*. The first rib 122*a* and the second rib 122*b* have the same length in the front-rear direction. In that configuration, the first channel 76*a* and the second channel 76*b* have the same channel length and the same cross-sectional area of the cross-section orthogonal to the channel length direction. The present teaching, however, is not limited thereto. The first channel 76*a* and the second channel 76*b* may have another configuration different from the above embodiment so that the first channel 76*a* and the second channel 76*b* have the same channel length and the same cross-sectional area of the cross-section orthogonal to the channel length direction.

The first channel 76*a* and the second channel 76*b* may have the same inertance, mutually different channel lengths, and mutually different cross-sectional areas of cross-sections orthogonal to a direction of the channel in which the liquid flows. The inertance of the first channel 76*a* may be different from that of the second channel 76*b*.

In the above embodiment, the heater 128 extends along the heating chamber 75 and the connecting channel 76. The present teaching is not limited thereto. The heater 128 may extend to face only the heating chamber 75, that is, may not face the connecting channel 76.

In the above embodiment, the case 27 includes the heating chamber 75 for heating the ink. The present teaching, however, is not limited thereto. The case 27 may not include the heating chamber 75 and the heater 128 for heating the ink in the heating chamber 75. Even in that case, the ink coming from the inlet 71*a* flows out of the two inflow-connecting ports 77*a*, 77*b*, and then flows into the head 21 from the two inlets 52*a*1, 52*d*1. Thus, as compared with a configuration in which the inlets 71*a* are provided for the two inflow-connecting ports 77*a*, 77*b* respectively, it is possible to further uniformize the viscosity etc., of the ink flowing into the head 21 from the inlet 52*a*1 and the viscosity etc., of the ink flowing into the head 21 from the inlet 52*d*1.

In the above embodiment, the sealer 55 is positioned between the head 21 and the case 27 while being in contact with the upper surface of the head 21 and the lower surface of the case 27 to prevent the ink from leaking therefrom. The present teaching, however, is not limited thereto. For example, the head 21 may be in contact directly with the case 27.

In the above embodiment, the case 27 is fixed to the head 21 via the sealer 55. The present teaching, however, is not limited thereto. For example, it is allowable that the case 27 is fixed to the head 21 via a first sealer, another channel structure, and a second sealer. In such a case, the first sealer is positioned between the case 27 and the another channel structure, and the second sealer is positioned between the another channel structure and the head 21. The first sealer and the second sealer are each a so-called packing made from a rubber material, similarly to the sealer 55. In this case, the another channel structure is provided with two inflow channels each having an end which communicates with one of the two inflow-connecting ports 77*a*, 77*b* of the case 27, and one outflow channel having one end which communicates with the outflow-connecting port 78 of the case 27. The other end of each of the two inflow channels is connected to one of the inflow ports 52*a*1 and 52*d*1, and the other end of the one outflow channel is connected to the outflow ports 52*b*1 and 52*c*1. Further, the first sealer is in contact with the case 27, is in contact with the another channel structure, and is in contact, for example, with the upper surface of the another channel structure. The second sealer is in contact with the another channel structure, is in contact, for example, with the lower surface of the another channel structure, and is in contact with the head 21. Note that it is allowable that the second sealer is adhered to the head 21, for example, via a silicone-based adhesive which is interposed between the second sealer and the head 21.

Figure 18:
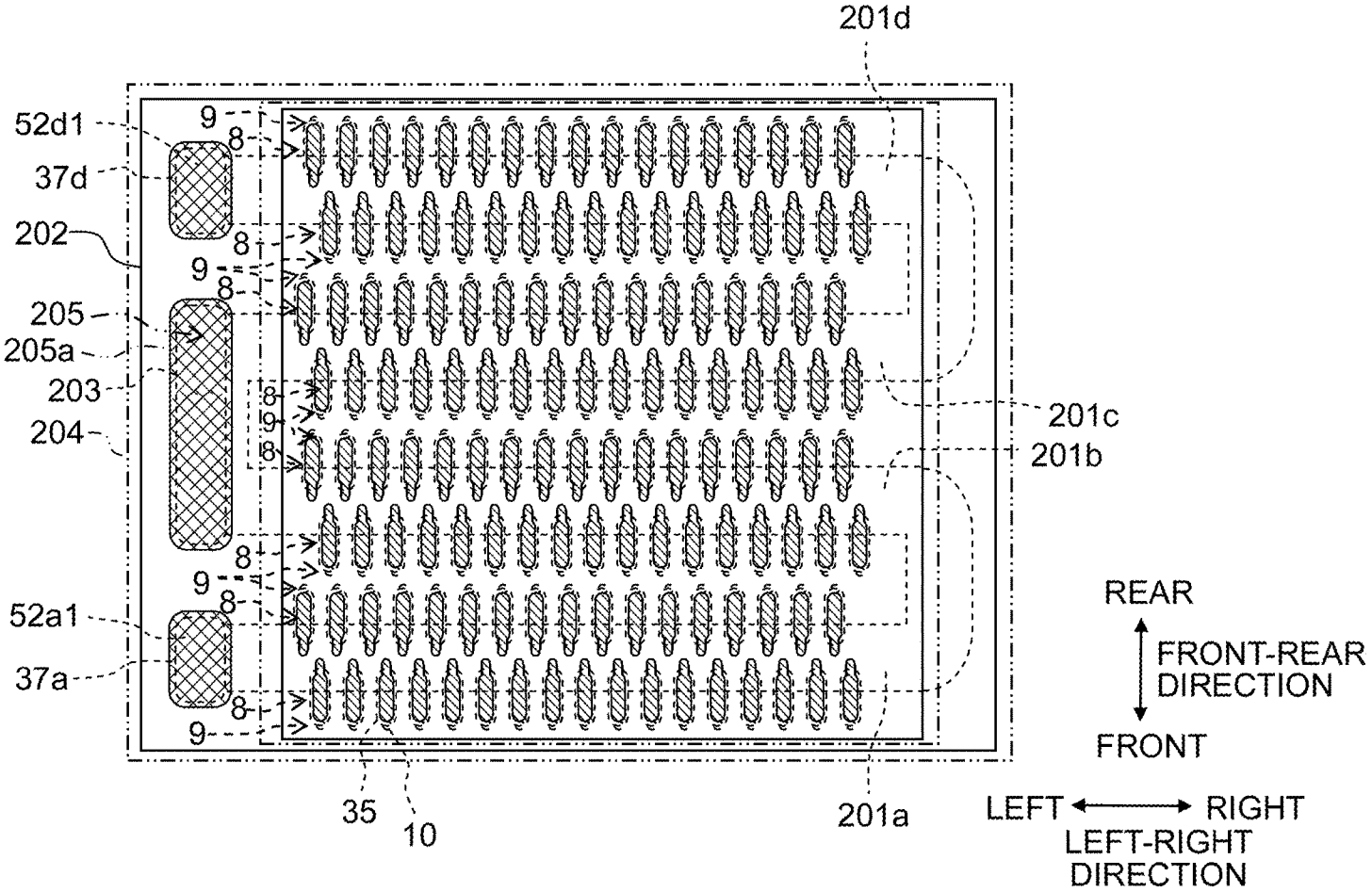
FIG. 18 is a view of a first modified embodiment corresponding to FIG. 8.

In the above embodiment, the outflow-connecting port 78 extending over the two outlets 52*b*1, 52*c*1 in the front-rear direction has an opening area larger than those of the two outlets 52*b*1, 52*c*1. The present teaching, however, is not limited thereto. In a first modified embodiment, as depicted in FIG. 18, there are four manifold channels 201*a* to 201*d* arranged in the front-rear direction, and a left end of a manifold channel 201*b* that is the second from the front is connected to a left end of a manifold channel 201*c* that is the third from the front. The connection part of the two manifold channels 201*b* and 201*c* includes an aperture 203 that is open in an upper surface of a channel member 202. A head holder 204 includes a through hole 205 at a position overlapping with the aperture 203 in the vertical direction. An upper end of the through hole 205 is an outlet 205*a* (an exemplary first outlet) that is open in an upper surface of the head holder 204. The outlet 205*a*, which has substantially the same opening area of that of the outflow-connecting port 78 (see FIG. 12B), is connected to the outflow-connecting port 78.

Figure 19:
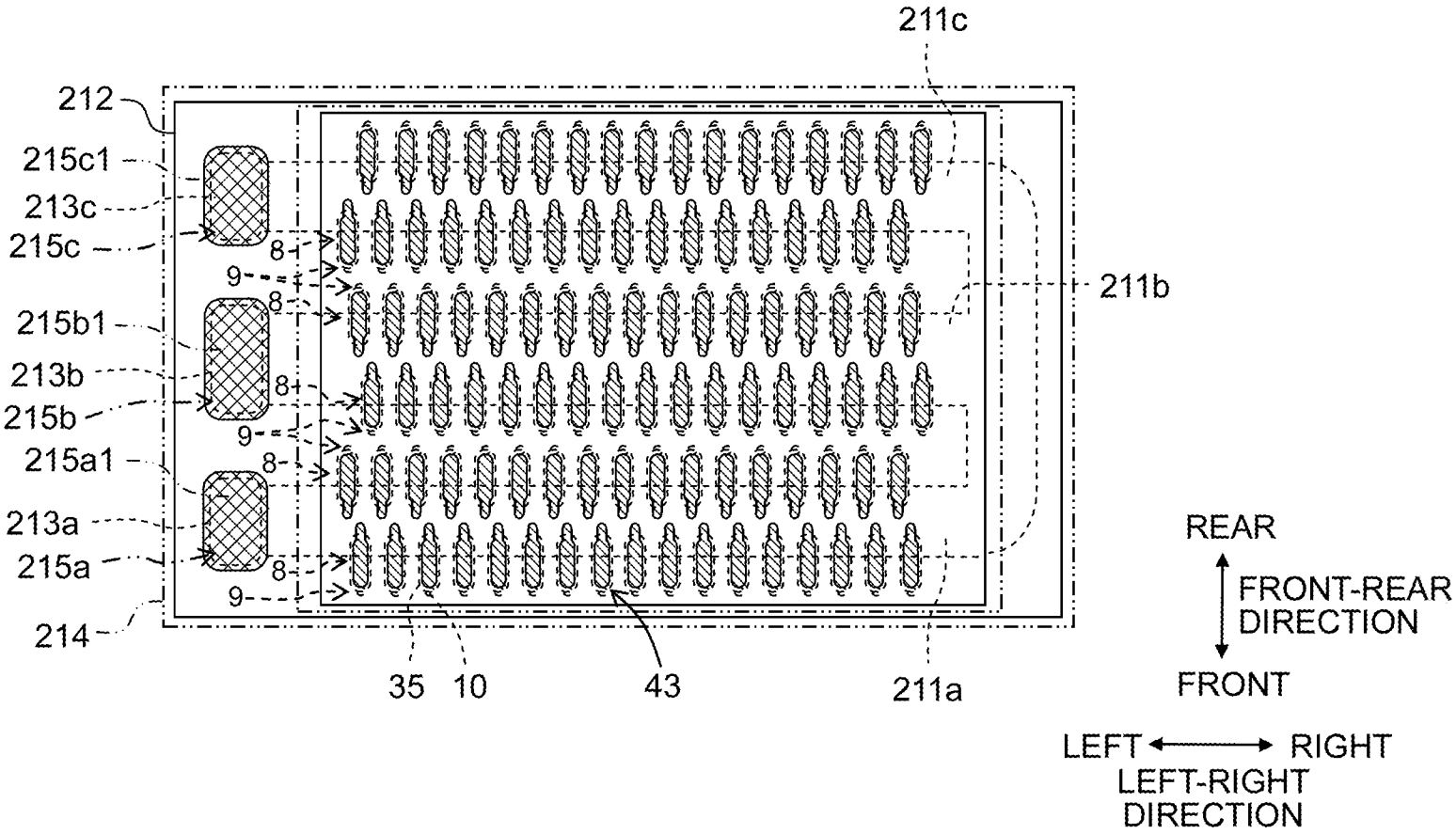
FIG. 19 is a view of a second modified embodiment corresponding to FIG. 8.

In the first modified embodiment, the two outlets 205*a* communicate with the two manifold channels 201*b* and 201*c* respectively. The present teaching, however, is not limited thereto. In a second modified embodiment, as depicted in FIG. 19, a head 210 includes six nozzle rows 9 arranged in the front-rear direction and three manifold channels 211*a* to 211*c* corresponding thereto. Right ends of the manifold channels 211*a* to 211*c* communicate with each other. The manifold channel 211*b* disposed at the center in the front-rear direction has a width larger than those of the remaining manifold channels 211*a* and 211*c* disposed at both ends in the front-rear direction (the manifold channel 211*b* has a length in the front-rear direction longer than those of the manifold channels 211*a* and 211*c*). Left ends of the manifold channels 211*a* to 211*c* respectively include openings 213*a* to 213*c* that are open in an upper surface of the channel member 212. Corresponding to this, parts of a head holder 214 overlapping with the openings 213*a* to 213*c* in the vertical direction include through holes 215*a* to 215*c*. Upper ends of the through holes 215*a* and 215*c* are inlets 215*a*1 and 215*c*1 that are open in an upper surface of the head holder 214, and an upper end of the through hole 215*b* is an outlet 215*b*1 that is open in the upper surface of the head holder 214. In that configuration, a spacing distance between the inflow-connecting port 77*a* and the inflow-connecting port 77*b* in the front-rear direction is shorter than that of the above embodiment. Further, the outflow-connecting port 78, which has a shape corresponding to the outlet 215*b*1, has substantially the same opening area as that of the outlet 215*b*1.

In the above embodiment, the outlets 52*b*1, 52*c*1 are positioned between the inlet 52*a*1 and the inlet 52*d*1 in the front-rear direction. The present teaching, however, is not limited thereto. For example, the inlets 52*a*1, 52*d*1 may be positioned between the outlet 52*b*1 and the outlet 52*c*1 in the front-rear direction.

In the above embodiment, the inlets 52*a*1, 52*d*1 and the outlets 52*b*1, 52*c*1 are arranged in the front-rear direction. The present teaching, however, is not limited thereto. For example, the inlets 52*a*1, 52*d*1 may be shifted from the outlets 52*b*1, 52*c*1 in the left-right direction. Or, the inlet 52*a*1 may be shifted from the inlet 52*d*1 in the left-right direction, and the outlet 52*b*1 may be shifted from the outlet 52*c*1 in the left-right direction.

In the above embodiment, the case 27 is supported by the upper surface of the head 21 (head holder 32). The present teaching, however, is not limited thereto. For example, the case 27 may be separated from the head 21 in the vertical direction, the inlet 52*a*1 may be connected to the inflow-connecting port 77*a* via a tube or the like, the inlet 52*d*1 may be connected to the inflow-connecting port 77*b* via a tube or the like, and the outlets 52*b*1, 52*c*1 may be connected to the outflow-connecting port 78 via a tube or the like.

In the above configuration, the case 27 and the head 21 may not be arranged in the vertical direction, the inlet 52*a*1 and the inflow-connecting port 77*a* may not overlap with each other in the vertical direction, the inlet 52*d*1 and the inflow-connecting port 77*b* may not overlap with each other in the vertical direction, and the outlets 52*b*1, 52*c*1 and the outflow-connecting port 78 may not overlap with each other in the vertical direction. For example, the case 27 may be shifted from the head 21 in the left-right direction or the front-rear direction. In that case, the inlet 52*a*1 and the inflow-connecting port 77*a* do not overlap with each other in the vertical direction, the inlet 52*d*1 and the inflow-connecting port 77*b* do not overlap with each other in the vertical direction, and the outlets 52*b*1, 52*c*1 and the outflow-connecting port 78 do not overlap with each other in the vertical direction.

In the above embodiment, the opening area of the outflow-connecting port 78 is larger than those of the inflow-connecting ports 77*a*, 77*b*. The present teaching, however, is not limited thereto. The opening area of the outflow-connecting port 78 may be equal to or smaller than those of the inflow-connecting ports 77*a*, 77*b*. Or, the inflow-connecting ports 77*a*, 77*b* may have mutually different opening areas, and the opening area of the outflow-connecting port 78 may be smaller than that of at least one of the inflow-connecting ports 77*a*, 77*b*.

The head may have another configuration different from the above embodiment, provided that the positional relation between the inlet(s) and the outlet(s) satisfies the above-described positional relation. The structure and positional relation of the COF substrate 22, the heat spreader 23, the flexible substrate 24, the rigid substrate 25, the substrate holder 26, the cooler 28, and the like may be different from those of the above embodiment. The cooler 28 may be omitted. In such a case, the heat transferred from the driver ICs 50 to the heat spreader 23 is released directly to the outside. Namely, in this case, the heat spreader 23 functions as a heat sink.

In the embodiment, the printing apparatus 1 is provided with the line head 4 having the head modules 11. The present teaching, however, is not limited thereto. For example, the printing apparatus may be a so-called serial type printing apparatus in which a carriage which is movable in the left-right direction has a head module 11 mounted thereon.

In the description above, the explanation has been given about the example in which the present teaching is applied to the printing apparatus configured to perform printing by jetting the inks from the nozzles. However, the example to which the present teaching is applicable is not limited to this. For example, the present teaching is also applicable to a printing apparatus configured to perform printing by jetting a liquid different from the ink(s), such as a material of a wiring pattern to be printed on a wiring board. Further, the present teaching is also applicable to a liquid jetting apparatus which is different from the printing apparatus.

What is claimed is:

1. A head module comprising a head and a case, the head including:

nozzles;

two first inlets through which the liquid flows into the head and which communicate with the nozzles; and a first outlet through which the liquid flows out of the head and which communicates with the two first inlets, the case including:

a second inlet through which the liquid supplied from an outside flows into the case;

two inflow-connecting ports communicating with the second inlet, each of the two inflow-connection ports being connected to one of the two first inlets;

an outflow-connecting port connected to the first outlet, and a second outlet communicating with the outflow-connecting port and through which the liquid flows out to the outside;

wherein the head and the case are arranged in a first direction, each of the first inlets overlaps with one of the inflow-connecting ports in the first direction, and the first outlet overlaps with the outflow-connecting port in the first direction.

2. The head module according to claim 1, wherein the outflow-connecting port has an opening area which is larger than an opening area of any of the two inflow-connecting ports.

3. The head module according to claim 1, wherein, in the head, the nozzles are arranged in a second direction orthogonal to the first direction, the two first inlets and the nozzles aligned are arranged in the second direction, and the two first inlets and the first outlet are arranged in a third direction orthogonal to the first direction and intersecting with the second direction.

4. The head module according to claim 3, wherein the first outlet is positioned between the two first inlets in the third direction.

5. The head module according to claim 4, wherein the first outlet includes two outlets, the two outlets are positioned between the two first inlets in the third direction, the outflow-connecting port has an opening area which is larger than each of opening areas of the two outlets, and the outflow-connecting port is connected to the two outlets.

6. The head module according to claim 3, wherein the case is supported by the head in the first direction.

7. The head module according to claim 6, further comprising a sealer connected to the head and the case in the first direction, wherein the sealer is positioned, in the first direction, between the two first inlets of the head and the two inflow-connecting ports of the case, and between the first outlet of the head and the outflow-connecting port of the case, such that the sealer surrounds the two first inlets of the head, the two inflow-connecting ports of the case, the first outlet of the head and the outflow-connecting port of the case.

8. The head module according to claim 7, wherein the sealer is connected to a first end of the case in the first direction, and the second inlet and the second outlet are positioned at a second end of the case in the first direction such that they are arranged in the third direction.

9. The head module according to claim 6, wherein the case includes:

a heating chamber;

a connecting channel connected to the heating chamber and the two inflow-connecting ports, and a first heater facing at least the heating chamber.

10. The head module according to claim 9, wherein the first heater faces the connecting channel.

11. The head module according to claim 9, wherein the case includes:

a first rib positioned between the heating chamber and the connecting channel; and a second rib separated from the first rib and positioned between the heating chamber and the connecting channel, the connecting channel is connected to the heating chamber at a position between the first rib and the second rib, and a first channel defined by the first rib and connected to one of the inflow-connecting ports has an inertance identical to that of a second channel defined by the second rib and connected to the other of the inflow-connecting ports.

12. The head module according to claim 11, wherein, in the connecting channel, the first channel has a length identical to that of the second channel, and the first channel has a cross-sectional area identical to that of the second channel.

13. The head module according to claim 11, wherein the first rib and the second rib extend in the third direction, the first rib and the second rib are separated from each other in the third direction, the case includes a third rib separated from the first rib and the second rib in the first direction and extending in the third direction to extend across the two inflow-connecting ports, and the first rib has a length in the third direction which is identical to that of the second rib.

14. The head module according to claim 9, wherein the case includes:

two walls defining a part of the heating chamber and separated from each other in the third direction; and a first partition positioned in the heating chamber, the heating chamber includes:

a heating chamber entrance through which the liquid flows into the heating chamber; and a heating chamber exit which is closer in the first direction to the head than the heating chamber entrance and through which the liquid flows out of the heating chamber, the first partition intersects with a straight line connecting the heating chamber entrance and the heating chamber exit, and the first partition extends from one of the two walls toward the other of the two walls and is separated from the other of the two walls.

15. The head module according to claim 14, wherein the case includes a second partition positioned in the heating chamber, the second partition intersects with the straight line connecting the heating chamber entrance and the heating chamber exit, the second partition extends from the other of the two walls toward the one of the two walls and is separated from the one of the two walls, the second partition is closer in the first direction to the head than the first partition, and the first partition and the second partition are arranged in the first direction.

16. The head module according to claim 14, wherein the heating chamber entrance is closer in the third direction to the one of the two walls than to the other of the two walls.

17. The head module according to claim 9, wherein the case includes a metallic plate defining at least a part of the heating chamber, and the first heater is fixed to the metallic plate.

18. The head module according to claim 9, wherein the case includes a second heater facing a channel which connects the outflow-connecting port and the second outlet.

19. The head module according to claim 3, wherein the case includes:

a filter of which filtering surface extends in the first direction; and a filter chamber accommodating the filter.

20. The head module according to claim 19, wherein the first direction is a vertical direction, and the case includes:

a filter chamber entrance being in the filter chamber at a position which is upstream in a flowing direction of the liquid in the filter chamber and is above the filtering surface; and a filter chamber exit being in the filter chamber at a position which is downstream of the flowing direction and is above the filtering surface.

21. The head module according to claim 3, wherein centers of the second inlet and the second outlet in the second direction are closer to the nozzles than centers of the inflow-connecting port and the outflow-connecting port.

22. A liquid jetting apparatus, comprising:

a plurality of pieces of the head module as defined in claim 3; and a module holder holding the head modules in a state where the head modules are arranged in the second direction.

23. A case configured to be supported by a head which includes: nozzles; two first inlets through which a liquid flows into the head and which communicate with the nozzles; and a first outlet through which the liquid flows out of the head and which communicates with the two first nozzles, the case comprising:

a second inlet through which the liquid supplied from an outside flows into the case;

two inflow-connecting ports communicating with the second inlet, each of the two inflow-connection ports being connected to one of the two first inlets;

a outflow-connecting port connected to the first outlet; and a second outlet communicating with the outflow-connecting port and through which the liquid flows to the outside;

wherein the head and the case are arranged in a first direction, each of the first inlets overlaps with one of the inflow-connecting ports in the first direction, and the first outlet overlaps with the outflow-connecting port in the first direction.

24. A head module comprising:

a head including:

nozzles extending along a first direction and arranged in a second direction orthogonal to the first direction;

two first inlets through which the liquid flows into the head and which communicate with the nozzles; and a first outlet through which the liquid flows out of the head and which communicates with the two first inlets, the first outlet being positioned between the two first inlets in a third direction orthogonal to the first direction and intersecting with the second direction, a case including:

a second inlet through which the liquid supplied from an outside flows into the case;

two inflow-connecting ports communicating with the second inlet;

an outflow-connecting port; and a second outlet communicating with the outflow-connecting port and through which the liquid flows out to the outside, the second inlet and the second outlet being arranged in the third direction, and a sealer including holes arranged in the third direction and each extending along the first direction, the sealer being positioned between the head and the case in the first direction and making contact with the head, wherein each of the two inflow-connecting ports of the case is communicated with each of the two first inlets of the head though each of two of the holes of the sealer, and the outflow-connecting port of the case is communicated with the first outlet of the head through the other of the holes.

* * * * *